US005953563A

United States Patent [19]

Yamaguchi et al.

[11] Patent Number: 5,953,563

[45] Date of Patent: Sep. 14, 1999

[54] DEVELOPMENT DEVICE OF IMAGE FORMING APPARATUS

[75] Inventors: Jun Yamaguchi; Yoshiaki Sanada, both of Ikoma; Yoshiki Itikawa, Kashihara, all of Japan

[73] Assignee: Sharp Kabushiki Kaisha, Osaka, Japan

[21] Appl. No.: 08/895,373

[22] Filed: Jul. 16, 1997

[30] Foreign Application Priority Data

Jul. 30, 1996 [JP] Japan ..... 8-200844

[51] Int. Cl.[6] ..... G03G 15/04

[52] U.S. Cl. ..... 399/119

[58] Field of Search ..... 399/53, 92, 93, 399/110, 119, 222, 252, 254, 256, 260, 264, 272, 274, 284

[56] References Cited

U.S. PATENT DOCUMENTS 4,194,465 3/1980 Tsukamoto et al. ..... 399/119 X
4,666,282 5/1987 Rowe ..... 399/93
4,700,659 10/1987 Hirakura et al. ..... 399/254
4,800,411 1/1989 Tanaka et al. .
4,963,930 10/1990 Yoshimaru et al. ..... 399/252 X
5,034,773 7/1991 Nimura et al. ..... 399/256
5,212,344 5/1993 Kageyama et al. ..... 399/274 X
5,223,898 6/1993 Fujii et al. ..... 399/254

*Primary Examiner*—Sandra Brase

[57] ABSTRACT

Vents are formed on a developer flow regulating plate inside a casing so as to reduce a pressure in a first space which increases as a developer holder rotates. Further, vents for connecting a vacuum space formed in front of a developer layer thickness regulating section for regulating a thickness of a developer layer formed on the surface of the developer holder and the outside air are formed. The vents thus formed for connecting the vacuum space and the outside air take in the outside air along the front face of the developer layer regulating section so as to increase the negative pressure in the vacuum space. A shape of a lower edge portion of an opening section formed on the casing is varied in a longitudinal direction so as to optimize an effect of suppressing a scattering of a developer. Furthermore, a rotation start timing of an agitating section for agitating the developer to be supplied to the developer holder is delayed from a rotation start timing of the developer holder. The described features permit the scattering of the developer to be suppressed.

21 Claims, 15 Drawing Sheets

51a
38
51a
51a
38

DEVELOPMENT DEVICE OF IMAGE FORMING APPARATUS

FIELD OF THE INVENTION

The present invention relates to a development device for use in an image forming apparatus employing an electrophotographic system such as an optical printer device, a copying machine, or a facsimile machine, etc.

BACKGROUND OF THE INVENTION

FIG. 19 illustrates an example of a conventional development device employed in a copying machine as an example of an image forming apparatus.

The above-mentioned development device includes a casing 80 having a rectangular shaped opening section 90 formed so as to face a photoreceptor 81, and a toner supply opening 83 formed on the casing 80.

Inside the casing 80, a developer roller 84 is provided in a vicinity of the photoreceptor 81. The developer roller 84 is composed of a fixed magnet roller 84*a* and a sleeve 84*b* rotatably mounted around the outer surface of the fixed magnet roller 84*a*. The sleeve 84*b* of the developer roller 84 is driven so as to rotate in a counterclockwise direction. On the surface of the sleeve 84*b*, a developer forms a layer having a brush-like surface (referred to as magnetic brushes hereinafter) as the developer is attracted magnetically by the magnetic force of the magnet roller 84*a* inside the developer roller 84. A doctor 85 for regulating the height of the magnetic brushes formed by the developer on the developer roller 84 is provided above the developer roller 84.

Further, inside the casing 80, in addition to the developer roller 84, first and second agitating rollers 86 and 87 are arranged in this order in a direction from the developer roller 84 to the toner supply opening 83. A transport magnet roller 88 is provided above the first and second agitating rollers 86 and 87, and a guiding plate 89 is provided between the transport magnet roller 88 and the first agitating roller 86.

The guiding plate 89 is provided such that the upper end portion thereof is positioned in a vicinity of the doctor 85, and the lower end portion thereof is inserted in the developer between the first agitating roller 86 and the second agitating roller 87. The developer regulated by the doctor 85 is guided to the lower end side of the guiding plate 89 along the upper surface of the guiding plate 89. The guiding plate 89 also plays a role in regulating the amount of the developer flowing into the side of the first agitating roller 86 through the clearance formed between the lower end of the guiding plate 89 and an inner wall surface 80*a* of the casing 80.

Additionally, the first and second agitating rollers 86 and 87 and the transport magnet roller 88 are driven so as to rotate in a synchronized motion in directions indicated by the arrows in FIG. 19 by a motor (not shown).

According to the above arrangement, toner, supplied through the toner supply opening 83, is agitated with the developer by the second agitating roller 87. As a result, the toner is charged in the opposite polarity to an electrostatic latent image formed on the photoreceptor 81 due to the friction with carrier in the developer. A portion of the developer including the charged toner is drawn back again by the transport magnet roller 88 along the guiding plate 89. The rest of the developer flows towards the first agitating roller 86 where it is further agitated.

The developer forwarded to the developer roller 84 is attracted magnetically to the sleeve 84*b* so as to form thereon the magnetic brushes. Here, the doctor 85 regulates the amount of the developer such that only a required amount of the developer is transported to the side of the photoreceptor 81 by the rotation of the sleeve 84*b*, then the electrostatic latent image formed on the photoreceptor 81 is developed.

In recent years, there has been a demand in the market for further decreasing the running cost. In order to meet such demand, an attempt has been made to achieve a longer life of the carrier of the developer by reducing a mechanical stress on the developer in the development device such as above, thereby reducing the running cost. However, reduction in the mechanical stress on the developer inevitably causes a decrease in the amount of charge of the toner. The reduction in the amount of charge of the toner generates another problem in that the toner scatters. For this reason, a quality copying machine that can meet the described demand in the market has not been realized.

An explanation of such case will be given referring to the development device shown in FIG. 19. In order to reduce the mechanical stress on the developer in the development device, firstly, the amount of the developer transported by the sleeve 84*b* is reduced so as to reduce the amount of the developer flowing into a space between the guiding plate 89 and the developer roller 84. Secondly, it is arranged such that the developer transported by the sleeve 84*b* is less likely to be held between the guiding plate 89 and the developer roller 84. As a result, the mechanical stress on the carrier can be reduced since a pressure is not applied to the developer.

However, the described arrangement has a drawback in that charging of the toner, as achieved by the friction between the carrier and toner of the developer cannot be expected in the state where the developer is held between the developer roller 84 and the guiding plate 89. For this reason, the amount of charge of the toner is inevitably reduced. Although the amount of charge of the toner can be increased by agitating at high speed, such high speed agitation also increases the stress on the developer.

As a result, as mentioned above, an attracting force between the toner and the carrier decreases, and an amount of a floating toner increases as a consequence. During the operation of the device, an internal pressure of the casing 80 increases due to the wind in the device generated by the rotations of the developer roller 84 and the first and second agitating rollers 86 and 87, etc., and also due to the developer flow. Consequently, the highly compressed air blows off through the opening section 90 formed on the casing 80, and the scattering of the toner occurs as the floating toner is caught in the air.

Generally, the developer does not adhere to the portions at the both ends of the developer roller 84 in the rotation axis direction. Consequently, the clearance formed between the surface of the developer roller 84 and the opening section 90 widens at the both end portions. As a result, the scattering of the toner from the both end portions of the opening section 90 in the longitudinal direction is more noticeable. The scattering of the toner in the described manner is further aggravated by a vacuum space C (refer to FIG. 19) formed in front of the doctor 85 by an air-flow rotating in response to the rotation of the developer roller 84. Additionally, the central portion of the opening section 90 has an arrangement where the air-flow rotating in response to the rotation of the developer roller 84 forms a laminar flow at the central portion in the longitudinal direction such that the floating toner is easily drawn back to the inside of the casing 80. Therefore, the amount of the scattering of the toner at the central portion is small compared with that at the side of the end portions.

Further, according to the described arrangement having the guiding plate 89, the upper end side of the guiding plate 89 is clogged with the developer regulated by the doctor 85. On the other hand, since the lower end portion of the guiding plate 89 is inserted in the developer, two spaces A and B parted by the guiding plate 89 are formed. As a consequence, the internal pressure of the space A where the opening section 90 is located becomes particularly high, thereby increasing the amount of the toner scattering through the opening section 90.

Meanwhile, methods for suppressing the scattering of the toner are disclosed in Japanese Unexamined Utility Model No. 142962/1989 (Jitsukaihei 1-142962), Japanese Unexamined Utility Model No. 196262/1986 (Jitsukaisho 61-196262), Japanese Unexamined Patent publication No. 139587/1990 (Tokukaihei 2-139587), Japanese Unexamined Patent publication No. 145570/1986 (Tokukaisho 61-145570), Japanese Unexamined Utility Model No. 170953/1987 (Jitsukaisho 62-170953), Japanese Unexamined Patent publication No. 244072/1987 (Tokukaisho 62-244072), and Japanese Examined Patent publication No. 39581/1989 (Tokukohei 1-39581).

① Japanese Unexamined Utility Model No. 142962/1989 (Jitsukaihei 1-142962)

According to the method for suppressing the scattering of the toner disclosed in this publication, in the case where two spaces are formed, in which a pressure increases and decreases respectively in response to the rotation of the developer roller, inside the casing, vents having filters are formed on the wall around a development tank encasing each space. The pressure difference between the inside and the outside of the development tank is equalized by connecting the each space to the outside, thereby suppressing the scattering of the toner.

② Japanese Unexamined Utility Model No. 196262/1986 (Jitsukaisho 61-196262)

According to the method for suppressing the scattering of the toner disclosed in this publication, a pressure in the casing is reduced by providing connecting means having a filter for connecting a space having a high pressure surrounded by the developer roller, the agitating rollers, and the casing, to the outside of the casing, thereby suppressing the scattering of the toner.

③ Japanese Unexamined Patent Application No. 139587/1990 (Tokukaihei 2-139587)

According to the method for suppressing the scattering of the toner disclosed in this publication, by providing an air flow guiding plate at the lower end side of the opening section formed on the casing as well as vents (pressure releasing pores) having filters on the casing, the pressure inside the casing is reduced, thereby suppressing the scattering of the toner.

④ Japanese Unexamined Patent Application No. 145570/1986 (Tokukaisho 61-145570)

According to the method for suppressing the scattering of the toner disclosed in this publication, in a development device having seal materials for sealing the clearance formed between the photoreceptor and the edge of the opening section formed at the upper end side of the opening section formed on the casing, vents (pressure releasing pores) having filters for suppressing a pressure increase inside the casing are formed in a vicinity of the doctor attached to the casing, thereby suppressing the scattering of the toner.

⑤ Japanese Unexamined Utility Model No. 170953/1987 (Jitsukaisho 62-170953)

According to the method for suppressing the scattering of the toner disclosed in this publication, by forming vents (air intake pores) for taking in the outside air in a vicinity of the both end portions of the developer roller in a rotation axis direction, and by forming a predetermined clearance between the edge portion of the opening section formed on a casing and the outer surface of the photoreceptor, an air-flow in a direction from the outside of the development device to the inside is generated, thereby suppressing the scattering of the toner.

⑥ Japanese Unexamined Patent Application No. 244072/1987 (Tokukaisho 62-244072)

According to the method for suppressing the scattering of the toner disclosed in this publication, by releasing the pressure inside the casing, and by setting a clearance between the edge portion of the opening section formed on the casing and the surface of the developer roller according to the thickness of a developer layer formed on the developer roller, an air-flow is circulated inside the casing, and the air is prevented from blowing off as a result, thereby suppressing the scattering of the toner.

⑦ Japanese Examined Patent Application No. 39581/1989 (Tokukohei 1-39581)

According to the method for suppressing the scattering of the toner disclosed in this publication, an air outlet is formed below the developer roller, and an air flow guiding plate is formed in a shape such that the clearance between the air flow guiding plate and the developer roller widens in a direction from the opening section of the casing to the downstream side of the developer roller so as to guide an air-flow to the air outlet such that an air-flow is generated so as to be sucked into the casing through the opening section, thereby suppressing the scattering of the toner.

Here, in the following explanations in the specification, if not specified, the scattering of the toner suggests that from the opening section, similarly, "the side portion" and "the central portion" etc. suggest those in the rotation axis direction of a developer holder (developer roller), and in the longitudinal direction of the development device.

However, according to the methods disclosed in the described publications ① through ⑤, the scattering of the toner can be suppressed, yet they have problems of a difficulty in maintenance, an increase in cost, the toner passing through the filter, and a deterioration of the image due to a black lead. Further, according to the methods disclosed in the above-described ⑥ and ⑦, the scattering of the toner is not suppressed uniformly in the rotation axis direction of the developer roller.

Namely, according to the methods of ① and ②, a portion in the casing having the highest pressure is connected to the outside air which requires a component such as a filter, etc., for reducing the pressure in the portion having a high pressure, thereby increasing the number of components and the cost. Further, since the air in the portion having a high pressure directly passes through the filter, the life of the filter is shortened, and a frequent replacement of the filter becomes necessary. Consequently, maintenance of the development device becomes difficult. Further, in the case where the air in the portion having a high pressure passes through the filter, the possibility of the floating toner passing through the filter increases, also the inside of the image forming apparatus is contaminated as the toner scatters out of the development device.

According to the methods disclosed in the publications ③ and ④, a portion in the casing having a pressure, although not the highest, is connected to the outside air so as to reduce the pressure in the casing. Therefore, as in the methods of ① and ② described above, the floating toner tends to pass through the filter, and it is required to replace the filter in a short cycle. The scattering of the toner tends to occur especially in the case where the pressure is suddenly increased immediately after the developer roller and the agitating rollers are started to be driven.

According to the method disclosed in the publication (5), the scattering of the toner is suppressed by forming vents for taking in the outside air in a vicinity of the both end portions of the developer roller. However, according to this arrangement, since the air is taken in from seal materials at the both ends, the adhesion of the toner to the front portion of the doctor cannot be prevented, so that the toner adheres to the doctor. The toner adhering to the doctor falls in the form of a mass, thereby generating the black lead on the image which lowers the quality of the image.

According to the methods disclosed in the publications (6) and (7), the lower end side of the opening section formed uniform on the casing has a uniform shape to the entire length in the longitudinal direction. Nevertheless, the developer does not adhere to the surface of the roller at both end portions of the developer roller. Further, since the developer does not adhere to the developer roller, the air is likely to be blown out of the inside of the casing. Moreover, a magnetic force of the developer roller decreases at the both end portions of the developer roller. The (6) and (7) fail to refer to such problem that directions of the air-flow around the developer roller differ between the central portion and the both end portions of the opening section, which causes a difference in the pattern of the scattering of the toner, thereby presenting a problem that the force of suppressing the scattering of the toner is not applied uniformly.

SUMMARY OF THE INVENTION

The present invention is achieved in finding a solution to the above-mentioned problems, and accordingly it is an object of the present invention to provide a development device for use in an image forming apparatus which permits a mechanical stress on developer to be reduced, and the scattering of toner resulting from the reduction in the mechanical stress to be prevented.

In order to achieve the above-mentioned objects, the development device of the image forming apparatus of the present invention includes:

a developer holder for supplying a developer to the photoreceptor, the developer holder being rotatably provided inside the casing having an opening section formed so as to face the photoreceptor, wherein a first space, formed on the side of the developer holder, having a pressure which increases as the developer holder rotates is parted from a second space having a lower pressure than that in the first space, and the development device of the image forming apparatus of the present invention further includes a connecting section for connecting the first space and second space.

According to this arrangement, highly compressed air in the first space is released to the second space having a low pressure through the connecting section, thereby reducing the pressure in the first space. With this reduction in the pressure, the scattering of the developer, or the toner of a two-component developer, through the opening section of the casing parting the first space is reduced. Namely, in the case where the first space having a high pressure and the second space having a low pressure exist in the casing, first, the scattering of the developer can be reduced by forming a vent having a filter by connecting the two spaces without making a connection to the outside. Here, the scattering of the developer indicates the scattering of the toner in the case of adopting the two-component developer, and will be referred to as the scattering of the toner hereinafter.

Further, in order to achieve the above-mentioned objects, the development device of the image forming apparatus of the present invention includes:

a developer holder for supplying a developer to the photoreceptor, the developer holder being rotatably provided inside the casing having an opening section formed so as to face the photoreceptor, and a rotatable agitating section for agitating the developer to be supplied to the developer holder, wherein when operating the development device, a rotation start timing of the developer holder and a rotation start timing of the agitating section are different.

In the case where the developer holder and the agitating section start being driven simultaneously, the pressure instantaneously increases by air-flow in the device generated by the rotations of the developer holder and the agitating section until the rotations of the developer holder and the agitating section, and the pressure in the casing are stabilized. In response to the increase in the pressure, the scattering of the toner occurs. In contrast, according to the afore-mentioned arrangement, when operating the development device, since the developer holder and the agitating section start rotating at different timing, the wind in the device is weakened. The weakening of the wind in the device suppresses the sudden increase in the pressure in the casing upon starting the operation, thereby suppressing the scattering of the toner.

Furthermore, in order to achieve the above-mentioned objects, the development device of the image forming apparatus of the present invention includes:

a developer holder for supplying a developer to the photoreceptor, the developer holder being rotatably provided inside the casing having an opening section formed so as to face the photoreceptor, and a developer layer thickness regulating section for regulating a thickness of a developer layer formed on the surface of the developer holder, the developer layer thickness regulating section fixed to the casing, wherein vents for connecting a vacuum space formed on a front surface portion of the developer layer thickness regulating section and an outside are formed in a vicinity of a fixed position of the developer layer thickness regulating section at both end portions in a longitudinal direction along a rotation axis of the developer holder in the casing.

According to this arrangement, the negative pressure in the vacuum space is increased as the outside air is taken in from the side of the end portions of the developer holder through the vents formed on the casing. Therefore, the scattering of the toner from both end portions of the developer holder, having a wider clearance from the opening section, that is aggravated by the vacuum space, can be effectively suppressed. Further, here, because the vents are formed on the casing in a vicinity of a position where the developer layer thickness regulating section is fixed, the outside air taken in through the vents flows along the front face of the developer layer thickness regulating section, thereby preventing the toner from adhering to the front face of the developer layer thickness regulating section, and avoiding a deterioration of an image caused by a black lead.

Moreover, in order to achieve the above-mentioned objects, the development device of the image forming apparatus of the present invention includes:

the developer holder for supplying the developer to the photoreceptor, the developer holder being rotatably provided inside the casing having an opening section formed so as to face the photoreceptor, wherein a shape of the edge portion of the opening section on the downstream side in the rotating direction of the developer holder is varied in the longitudinal direction along the rotation axis direction of the developer holder so as to suppress the scattering of the developer from the opening section.

According to this arrangement, since a shape of the edge portion of the opening section on the downstream side in the rotating direction of the developer holder is varied in the longitudinal direction along the rotation axis direction of the developer holder so as to suppress the scattering of the developer from the opening section, the effect of suppressing of the scattering of the toner can be optimized.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a cross sectional view showing the guiding plate taken on the line VI(*b*)—VI(*b*).

FIG. 9(*b*) is a cross sectional view showing the guiding plate taken on the line IX(*b*)—IX(*b*).

FIG. 10(*b*) is a cross sectional view showing the guiding plate taken on the line X(*b*)—X(*b*).

FIG. 11(*b*) is a cross sectional view showing the guiding plate taken on the line XI(*b*)—XI(*b*).

FIG. 12(*b*) is an explanatory view showing the front cover section as seen from the side.

FIG. 13(*b*) is an explanatory view showing the front cover section as seen from the side.

FIG. 15(*b*) is explanatory view showing the clearance at the side of the end portion.

FIG. 16(*b*) is an explanatory view showing the lower casing section as seen from the front.

DESCRIPTION OF THE EMBODIMENTS

The following explains one embodiment of the present invention referring to the attached drawings. In the present embodiment, descriptions will be given through the case where an development device of the present invention is employed in a copying machine having a double-sided copying function as an image forming apparatus.

Figure 3:
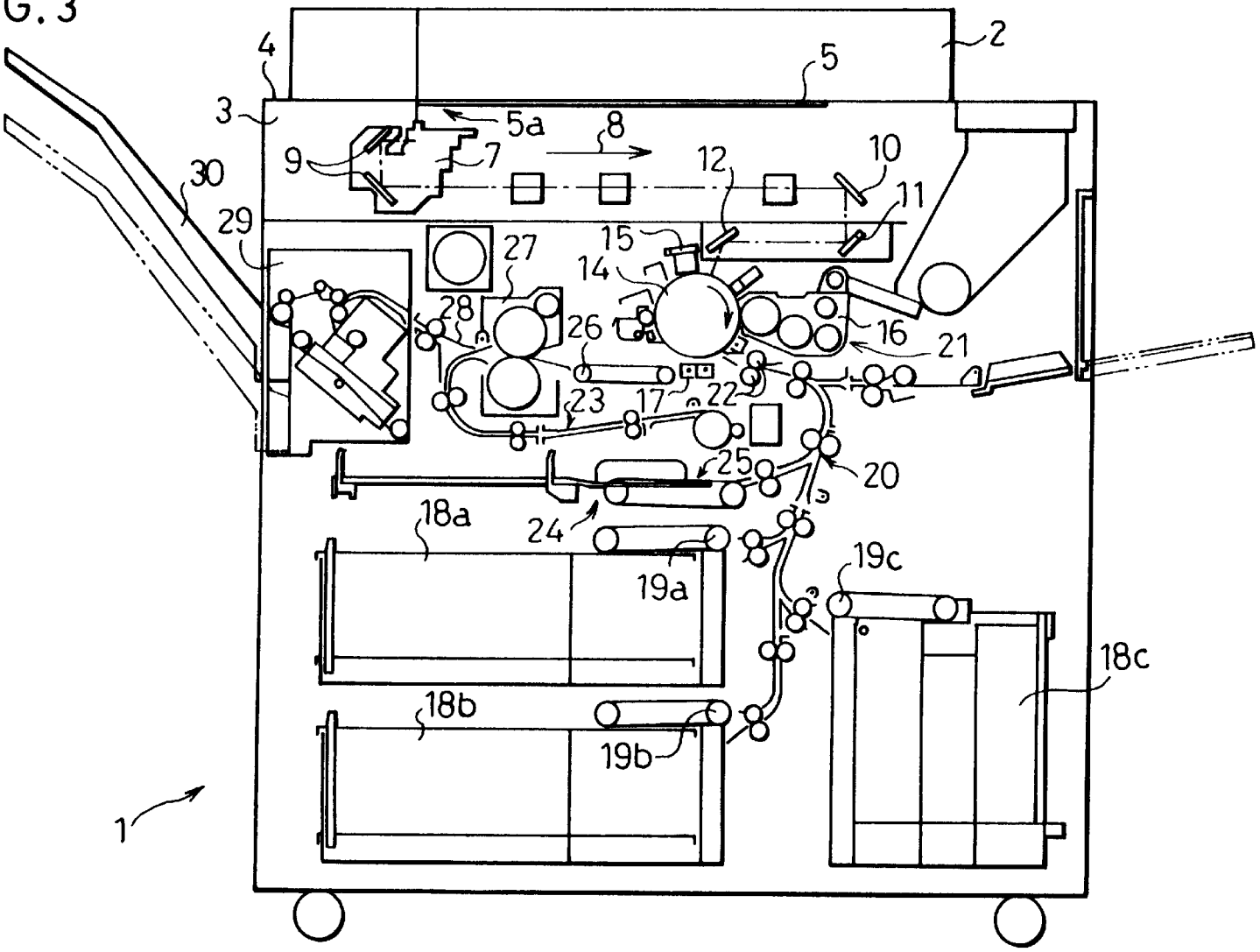
FIG. 3 is a drawing showing the entire arrangement of the copying machine.

First, an arrangement of the copying machine of the present embodiment will be explained based on a processing sequence referring to FIG. 3.

A copying machine 1 has a transparent plate 5, made of hardening glass, etc., formed on the upper surface 4 of a copying machine main body 3. The transparent plate 5 serves as a document reading section (face). A document supplying section 2 is provided on the transparent plate 5 in such a manner that the angle thereof can be adjusted as desired with respect to the axis of rotation (not shown). The document supplying unit 2 is provided for automatically supplying a document stacked in a document storing section (not shown) to a reading position 5*a* in order, and an document image is set. An exposing operation for reading the document image is carried out as the document image presented is optically scanned by optical reading means provided in the copying machine 1. A document with its document image read in the described manner is stored again in the document storing section. In this manner, the document stacked in the document storing section is supplied in order in the described circulation, and one-sided copying and double-sided copying to a recording sheet are performed.

As described, the exposing operation for reading a document image is carried out by the optical reading means with respect to the document image presented on the reading position 5*a*. In the optical reading means, a moving body 7 including a light source such as a halogen lamp (not shown)

and a plurality of reflecting mirrors 9 project light on the document that has been set by reciprocating horizontally in the direction of the arrow 8 to the reading position 5*a*. A reflected light of the light projected on the document is converged on a photoreceptor drum having a right circular cylindrical shape (photoreceptor) 14 which is driven to rotate in the direction of the arrow by the reflective mirrors 10, 11, and 12.

The surface of the photoreceptor drum 14 is charged beforehand by a charging-use corona discharger 15, and an electrostatic latent image corresponding to the document image is formed thereon by the convergence of the document image. The electrostatic image is developed into a toner image by a development device 16, and copied to one face of the recording sheet by a transfer-use corona discharger 17. The recording sheet is stored beforehand in sheet feeding cassettes 18*a*, 18*b*, and 18*c*, and fed one by one by transport means 19*a*, 19*b*, and 19*c*. The recording sheet thus fed is guided to a transfer region 21 where a transfer operation is carried out after being transported through a transport path 20.

A pair of register rollers 22 is provided in a vicinity of the transfer region 21 of the transport path 20, and power transmitting means is connected to the rotation axis of the register roller 22 through a clutch (not shown). By carrying out a connecting/disconnecting control of the clutch under the control of the transport timing of the document in the document supplying unit 2, the transport timing of a recording sheet on which a toner image has been transferred is conformed to the toner image on the photoreceptor drum 14 by the register rollers 22. The recording sheet having the toner image transferred thereon by the corona discharger for copying 17 is guided from transport means 26 to a fixing unit 27 where the toner image is fixed.

The recording sheet fixed in the above-described manner is once stored in an intermediate tray 24 as the transport direction of the recording sheet is reversed by reversing means 23. The recording sheet in the intermediate tray 24 is supplied again to the transport path 20 by the transport means 25, and is guided by the register rollers 22 again to the transfer region 21 where the toner image is copied to the other face of the recording sheet.

The recording sheet finished with copying is discharged to a discharge tray 30 outside the device through the transport means 26, the fixing unit 27, the transport path 28, and a sheet discharge mechanical section 29. In this manner, document images of a document respectively corresponding to each face of the recording sheet are copied.

Additionally, in the case of one-sided copying, the recording sheet with a copied image on one face is discharged to the discharge tray 30 without being stored in the intermediate tray 24. Recording sheets of different sizes, for example, are selectively transported respectively from the sheet feeding cassettes 18*a*, 18*b*, and 18*c* to the transfer region 21.

Figure 1:
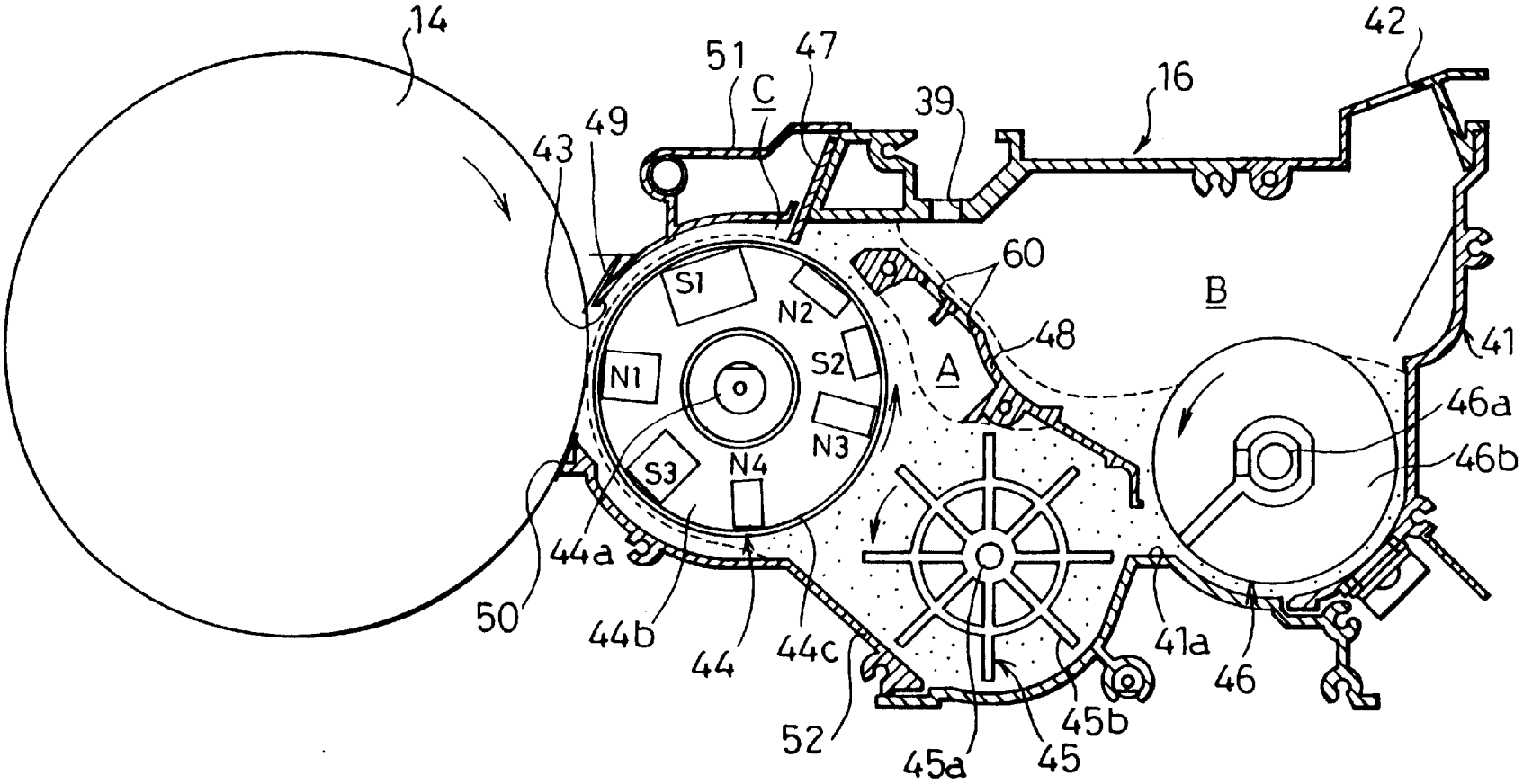
FIG. 1 is a cross sectional view taken at the central portion in the longitudinal direction showing one example of a development device employed in a copying machine according to one embodiment of the present invention.
Figure 2:
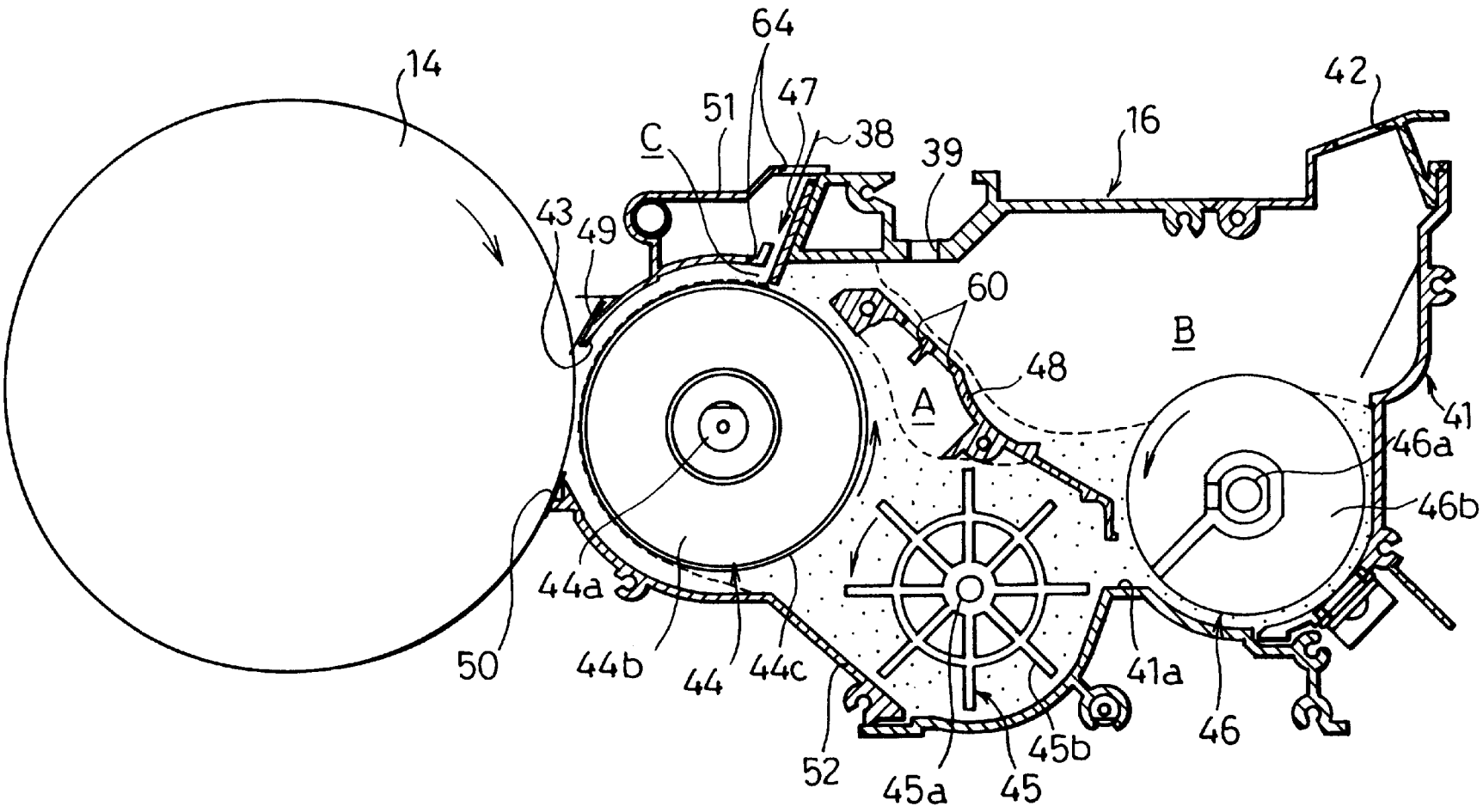
FIG. 2 is a cross sectional view taken at the side of the end portion in the longitudinal direction of the development device.

Incidentally, as shown in FIG. 1 which is a cross sectional view taken at the central portion of the development device 16, or FIG. 2 which is a cross sectional view taken at the end portion of the development device 16, the development device 16 of the present embodiment includes a casing 41 having a rectangular shaped opening section 43 formed so as to face the photoreceptor drum 14. The opening section 43 is formed on one end portion of the casing 41 in the horizontal direction. Further, a toner supply opening 42 for supplying toner is formed on the upper portion of the casing 41. The toner supply opening 42 is formed on the other end portion of the casing 41 in the horizontal direction.

Inside the casing 41, a developer roller 44 is positioned so as to oppose the photoreceptor 14 through the opening section 43. Further, first and second agitating rollers 45 and 46 are arranged in this order in a direction from the developer roller 44 to the toner supply opening 42. Moreover, a doctor 47 and a guiding plate 48 are respectively positioned above the developer roller 44 and substantially at the central portion inside the casing 41.

The developer roller (developer holder) 44 supplies a two-component developer composed of toner and carrier to the photoreceptor drum 14. The developer roller 44 is mounted on a supporting shaft 44*a* which is rotatably supported by the casing 41. The developer roller 44 is composed of a magnet roller 44*b* fixed to the casing 41 and a sleeve 44*c* which is rotatably mounted to the magnet roller 44*b*. The sleeve 44*c* is driven by a motor (not shown) so as to rotate in the direction of the arrow (in the opposite direction to the rotating direction of the photoreceptor drum 14, for example, in a counterclockwise direction).

Figure 4:
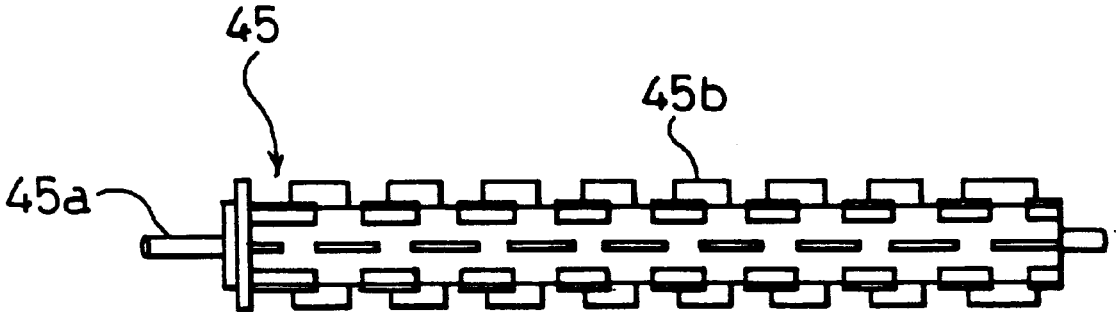
FIG. 4 is a front view showing a first agitating roller provided in the development device.
Figure 5:
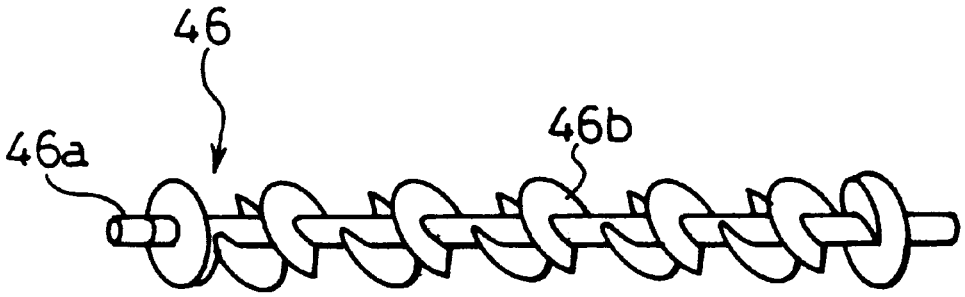
FIG. 5 is a perspective view showing a second agitating roll provided in the development device.

As shown FIG. 4, the first agitating roller (agitating section) 45 is composed of a roller shaft 45*a* rotatably supported by the casing 41 and a large number of fins 45*b* projecting perpendicularly with respect to the roller shaft 45*a*. As shown in FIG. 5, the second agitating roller (agitating section) 46 is composed of a roller shaft 46*a* rotatably supported by the casing 41 and a large number of elliptical fins 46*b* inclined with respect to the roller shaft 46*a*. The first and second agitating rollers 45 and 46 are driven by a motor (not shown) so as to rotate in the direction of the arrow in FIGS. 1 or 2.

The doctor (developer layer thickness regulating section) 47 is a flat plate extending in the rotation axis direction of the developer roller 44. The doctor 47 regulates the height of magnetic brushes formed by the developer on the developer roller 44 according to the distance of a space between the outer surface of the developer roller 44 and the tip of the doctor 47.

The guiding plate (developer-flow regulating plate) 48 is substantially a flat plate extending in the direction of the axis of the developer roller 44. The upper end portion of the guiding plate 48 is positioned in a vicinity of the rear face of the doctor 47, and the lower end portion of the guiding plate 48 is inclined so as to be positioned between the first agitating roller 45 and the second agitating roller 46. The developer regulated by the doctor 47 is guided towards the side of the lower end portion of the guiding plate 48 as the developer flows along the upper surface of the guiding plate 48. Additionally, the lower end portion of the guiding plate 48 is inserted in the developer, and the space formed between the lower end portion of the guiding plate 48 and an inner wall surface 41*a* of the casing 41 controls an amount of the developer supplied from the side of the second agitating roller 46 to the side of the first agitating roller 45.

Furthermore, the edge of the upper portion (edge portion of the upstream side of the rotating direction of the developer roller 44) of the opening section 43 formed on the casing 41 is provided with an upper portion seal material 49 with respect to substantially the entire area in the longitudinal direction so as to prevent the toner from leaking from the inside of the casing 41. The seal material 49 is made of a urethane rubber having a thickness of 0.1 mm, for example, and arranged such that its tip contacts the photoreceptor drum 14. Further, the edge of the lower portion (edge portion of the downstream side of the rotating direction of the developer roller 44) of the opening section 43 is provided with an air flow regulating plate 50 with respect to substantially the entire area in the longitudinal direction while maintaining a predetermined space between the photoreceptor drum 14 and thereof.

In the development device 16 having the described arrangement, the developer inside the casing 41 is agitated by the second agitating roller 46, and transported to the side of the first agitating roller 45 by the rotation of the second agitating roller 46 through the space between the lower end portion of the guiding plate 48 and the inner wall surface 41*a* of the casing 41. The developer thus carried is agitated by the first agitating roller 45, and is supplied to the developer roller 44 by the rotation of the first agitating roller 45. By agitating the developer, the toner is charged in the opposite polarity to an electrostatic latent image formed on the photoreceptor drum 14 due to the friction between the toner and the carrier.

The developer supplied to the developer roller 44 is drawn up by the rotation of the sleeve 44*c* of the developer roller 44. Here, the developer forms the magnetic brushes on the surface of the sleeve 44*c* by the magnetic force of the magnet roller 44*b*. After the height of the magnetic brushes is regulated by the doctor 47, the developer is supplied to the photoreceptor drum 14, and the electrostatic latent image on the photoreceptor drum 14 is developed. On the other hand, the developer regulated by the doctor 47 flows along the upper surface of the guiding plate 48, and is agitated again by the second agitating roller 46 together with a supplied toner supplied through the toner supply opening 42.

Next, methods for suppressing the scattering of the toner from the opening section 43 which is adopted by the above-described development device 16 will be explained in detail. In the development device 16, the following 4 methods (1) through (4) are carried out for the purpose of suppressing the scattering of the toner:

(1) A pressure in a space A is released by forming vents 60 on the guiding plate 48.

(2) Vents 64 for taking in the outside air along the front face of the doctor 47 are formed by connecting a vacuum space C formed in front of the doctor 47 to the outside, thereby increasing the negative pressure in the vacuum space C.

(3) The shape of the edge of the lower portion of the opening section 43 is varied in the longitudinal direction so as to optimize the effect of suppressing of the scattering of the toner.

(4) The rotation start timing of the first and second agitating rollers 45 and 46 is delayed with respect to the rotation start timing of the developer roller 44.

First, the method of (1) will be explained.

In an arrangement having the guiding plate 48 such as the above-described development device 16, since the upper end portion of the guiding plate 48 is clogged with the developer regulated by the doctor 47, and the lower end portion of the guiding plate 48 is inserted in the developer, two spaces A and B separated by the guiding plate 48 are formed. Further, due to the wind caused by the rotations of the developer roller 44 and the first and second agitation rollers 45 and 46, and also due to the developer flow, the internal pressure of the space A (a first space) where the opening section 43 is located becomes particularly higher than that of a space B (a second space). As a result, the air blows off from the opening section 43, and the floating toner is caught in the blowing air, thereby causing the scattering of the toner.

Figure 6A:
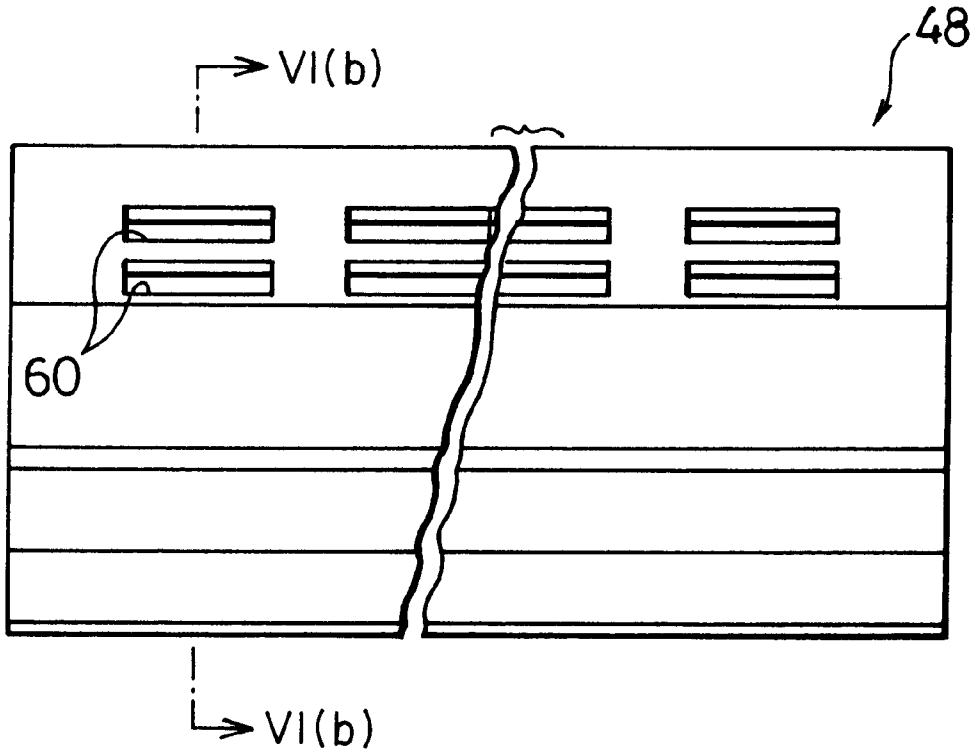
FIG. 6(*a*) is an explanatory view showing a guiding plate as seen from the front provided in the development device.
Figure 6B:
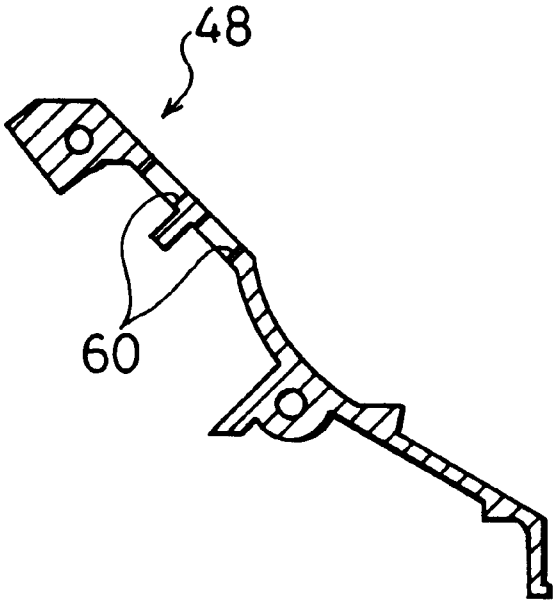

As a countermeasure, as shown in FIG. 6, the vents (connecting section) 60 are formed on the guiding plate 48 of the development device 16. FIG. 6(*a*) is a front view of the guiding plate 48, and FIG. 6(*b*) is a cross sectional view taken on the line VI(*b*)—VI(*b*) of FIG. 6(*a*).

According to this arrangement, highly compressed air in the space A flows into the space B through the vents 60. As a result, the pressure in the space A reduces, thereby suppressing the blowing off of the air from the opening section 43, and reducing the scattering of the toner. The above-described effects can be achieved only by forming the vents 60 on the guiding plate 48, therefore, neither the number of components nor the cost increases.

Furthermore, the described development device 16 has a pressure releasing opening 39 having a filter (not shown) formed on a portion at which the space B is parted in the casing 41. According to this arrangement, the air in the space B is released out of the casing 41 from the pressure releasing opening 39 through the filter. As a result, the pressure in the space A is further reduced, and a still improved effect of suppressing the scattering of the toner can be achieved.

Incidentally, an arrangement where the pressure releasing opening is formed on the casing has been known conventionally. In this conventional arrangement, the scattering of the toner can be suppressed by directly releasing the pressure in the space A through the pressure releasing opening. However, in the case where the pressure is released directly from the space A, it is required to replace the filter attached to the pressure releasing opening more frequently, thereby making it more difficult to perform maintenance of the development device 16. Further, such problem that the toner passes through the filter in response to the blowing off of the highly compressed air may arise.

However, as described above, the highly compressed air in the space A is led to the space B by forming the vents 60 on the guiding plate 48, and the highly compressed air is allowed to pass through the pressure releasing opening 39 after the high pressure is once reduced in the space B. As a result, a replacement of the filter requires less frequently, and the toner can be prevented from passing through the filter.

Figure 7:
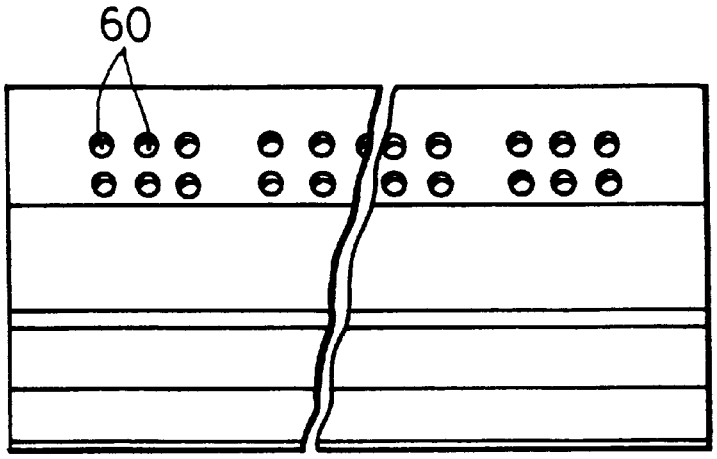
FIG. 7 is an explanatory view showing another example of the guiding plate provided in the development device.
Figure 8:
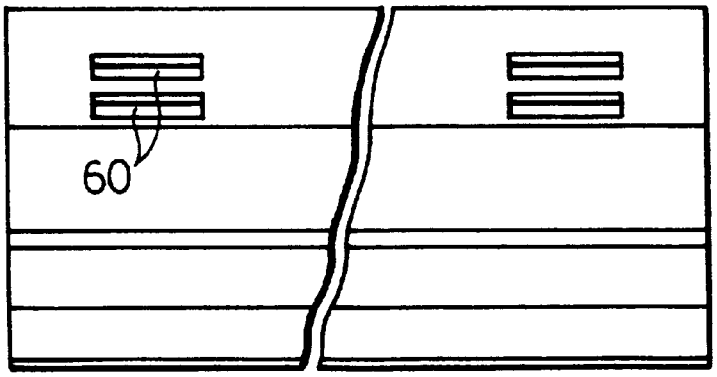
FIG. 8 is an explanatory drawing showing still another example of the guiding plate provided in the development device.

Here, the shape and the position of the vents 60 formed on the guiding plate 48 provided in the development device 16 are not limited to those shown in FIG. 6. For example, vents having a circular shape, as shown in the guiding plate of FIG. 7, may be used, or as shown in FIG. 8, a guiding plate having an arrangement where the vents 60 are formed only on the side of the both end portions of the guiding plate may be used as well. As described above, since the scattering of the toner is noticeable at the end portions of the developer roller 44, even in the case where the vents 60 are formed only on the side of the both end portions of the guiding plate, a satisfactory effect can be obtained.

Figure 9:
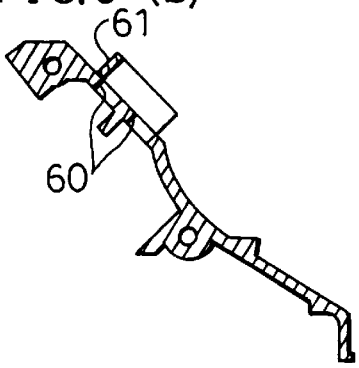
FIG. 9(*a*) is an explanatory view showing yet still another example of the guiding plate provided in the development device.
Figure 9A:
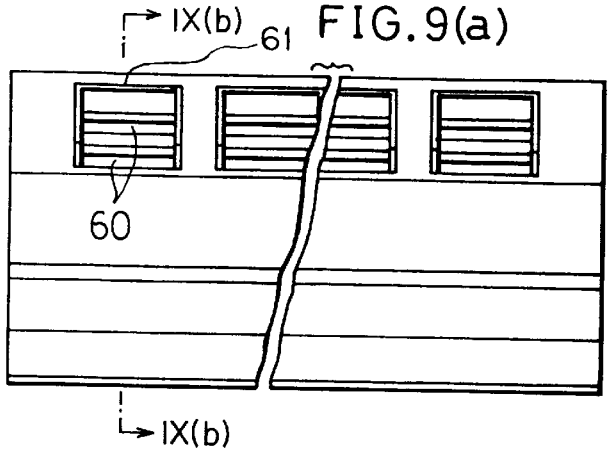
Figure 10:
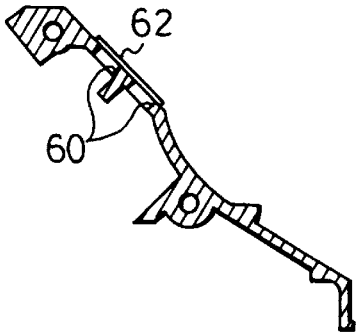
FIG. 10(*a*) is an explanatory view showing yet still another example of the guiding plate provided in the development device.
Figure 10:
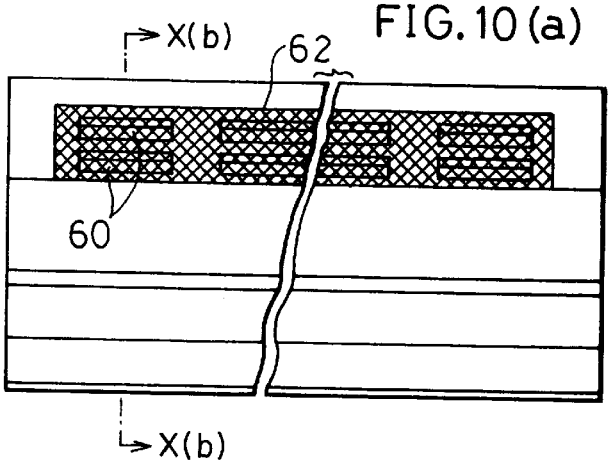
Figure 11:
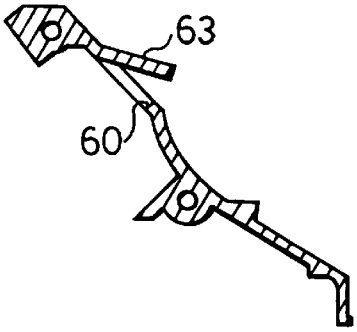
FIG. 11(*a*) is an explanatory view showing yet still another example of the guiding plate provided in the development device.
Figure 11A:
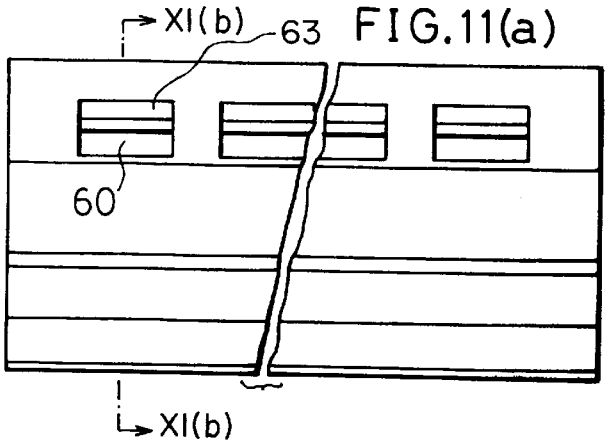

In addition, guiding plates having arrangements shown in FIG. 9(*a*) and FIG. 9(*b*) through FIG. 11(*a*) and FIG. 11(*b*) also can be used as the guiding plate 48 of the development device 16 of the present embodiment. FIG. 9(*a*) is a front view of another example of the guiding plate, FIG. 9(*b*) is a cross sectional view taken on the line IX(*b*)—IX(*b*) of FIG. 9(*a*). FIG. 10(*a*) is a front view of still another example of the guiding plate, and FIG. 10(*b*) is a cross sectional view taken on the line X(*b*)—X(*b*) of FIG. 10(*a*). FIG. 11(*a*) is a front view of yet another embodiment of a guiding plate, and FIG. 11(*b*) is a cross sectional view taken on the line XI(*b*)—XI(*b*) of FIG. 11(*a*).

The respective guiding plates shown in above-mentioned FIG. 9 through FIG. 11 are capable of completely preventing poor agitation of the developer. Namely, generally, even in the case where the guiding plate 48 of FIG. 6 is adopted, considering the speed of the developer flowing along the upper surface of the guiding plate 48, it is unlikely that the developer falls through the vents 60. However, in the case where polar magnetic drawing power of the developer roller 44 is weak, or the flowing characteristic of the developer is not sufficient, the amount of the developer that falls through the vents 60 increases as the developer flow is weakened, thereby generating a possibility of poor agitation.

As a countermeasure, the guiding plate of FIG. 9 is provided with a cover (fall preventing member) 61 formed on the upstream side of the vents 60 in a flowing direction of the developer. According to this arrangement, falling of the developer from the vents 60 is completely prevented, thereby preventing poor agitation.

The guiding plate of FIG. 10 is provided with a mesh cover (fall preventing member) 62 made of a mesh material attached so as to cover the vents 60. According to this arrangement, as the cover 61 shown in FIG. 9, the developer can flow smoothly without staying on the cover 61. The mesh size d of the mesh material of the mesh cover 62 is not particularly limited, and any mesh material having a smaller mesh size than an average diameter of the developer may be adopted. Specifically, in the case of adopting a two-component developer as in the present embodiment, it is required to set the mesh interval smaller than at least an average diameter of the carrier to satisfy, for example, the following inequality:

$$\text{Average Toner Particle Diameter}\times 2<d<\text{Average Carrier Particle Diameter}\times 0.8$$

The guiding plate shown in FIG. 11 has a cover (fall preventing member) 63 formed by bending upwards the cut out portions corresponding to the vents 60 of the guiding plate by press working. The described arrangement where the cover 63 and the guiding plate are integrally formed is advantageous over the aforementioned arrangements of FIG. 9 and FIG. 10 where the cover 61 and the mesh cover 62 are formed on the guiding plate in that a required number of components can be reduced and the cost can be kept low.

Next, the above-mentioned method of (2) will be explained.

Generally, since the developer does not adhere to the both end portions of the developer roller 44, a wide interval is formed between the surface of the developer roller 44 and the opening section 43. Therefore, the scattering of the toner from the side of the both end portions of the opening section 43 is noticeable. Moreover, such scattering of the toner is further aggravated by the vacuum space C formed in front of the doctor 47 due to an air-flow which circulates in response to the rotation of the developer roller 44.

As a countermeasure, as shown in FIG. 2, the casing 41 of the development device 16 of the present embodiment includes the vents 64 for connecting the vacuum space C formed in front of the doctor 47 to the outside. The vents 64 are formed in a vicinity of the both end portions (portions corresponding to the both end portions of the developer roller 44) where the doctor 47 is positioned. According to this arrangement, a blowing wind 38 shown by the arrow in FIG. 2 is introduced into the vacuum space C from the side of the both end portions of the developer roller 44, thereby increasing the negative pressure in the vacuum space C, and suppressing the scattering of the toner from the side of the both end portions of the opening section 43.

Here, the vents 64 are formed in a vicinity of a portion where the doctor 47 is positioned so as to allow the blowing wind 38 to flow along the front face of the doctor 47. According to this arrangement, the toner does not adhere to the front face of the doctor 47 due to the blowing wind 38, thereby preventing the generation of the black lead which is caused by the toner adhered to the front face of the doctor 47 being peeled off and falling as a lump, and avoiding the deterioration of an image caused by the generation of the blacklead.

Figures 12A, 12B:
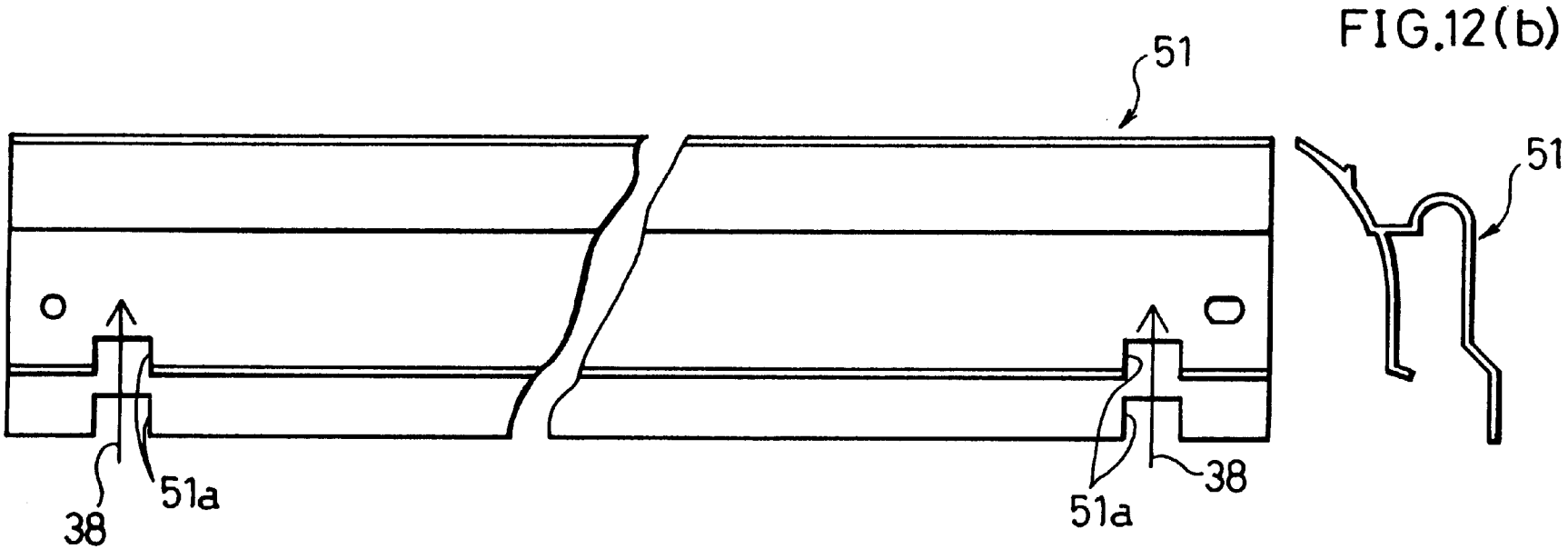
FIG. 12(*a*) is an explanatory view showing one example of a front cover section as seen from the front which is a component of a casing in the development device.

Specifically, as shown in FIG. 12, a front cover section 51, which is a component of the casing 41, located in front of the doctor 47 including a portion consisting the edge of the upper portion of the opening section 43 is provided with cut out areas 51*a* formed respectively on the side of the both end portions of the front cover section 51 contacting the doctor 47. Here, the cut areas 51*a* are the vents 64. FIG. 12(*a*) is a front view of the front cover section 51, and FIG. 12(*b*) is a side view of the front cover section from the right.

Figures 13A, 13B:
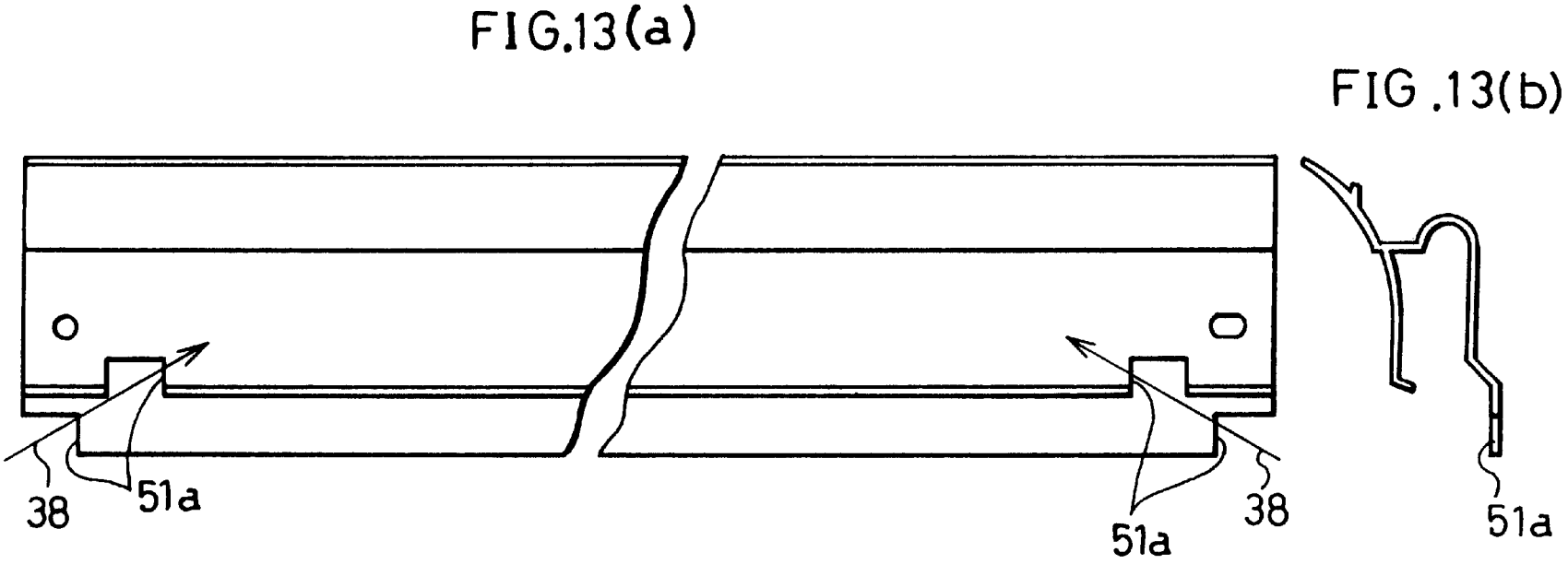
FIG. 13(*a*) is an explanatory view showing another example of a front cover section as seen from the front which is a component of the casing in the development device.

Further, for the front cover section 51 which constitutes the casing 41 of the development device 16 of the present embodiment, a front cover section shown in FIG. 13 may be adopted. FIG. 13(*a*) is a front view of the front cover section, and FIG. 13(*b*) is a side view of the front cover section from the right.

The front cover section has the cut out areas 51*a* formed at the both end portions along the side contacting the doctor 47. The cut out areas 51*a* are formed in order to direct the blowing wind 38 indicated by the arrow from the side of the end portions to the central portion. According to this arrangement, due to the air-flow of the blowing wind 38 flowing towards the center, the floating toner can be carried to the central portion of the developer roller 44. Then, the toner can be drawn back to the inside of the casing 41 again with the air-flow rotating in response to the rotation of the developer roller 44, thereby more effectively preventing the scattering of the toner.

Incidentally, due to the small sizes of the vents 64, the air introduced from the vents 64 flows at a relatively high speed until it reaches the vacuum space C. However, upon reaching the vacuum space C, the introduced air spreads in the longitudinal direction along the rotation axis direction of the developer roller 44 such that the speed of the air-flow is reduced to the rotation speed of the sleeve 44*c* of the developer roller 44.

Therefore, in the case where the vents 64 are formed at a position where the magnet pattern of the magnet roller 44*b* of the developer roller 44 has the peak, the air is blown against the magnetic brushes having a large area contacting the air. As a result, the toner is blown up, and the scattering of the toner cannot be suppressed effectively.

Figure 14:
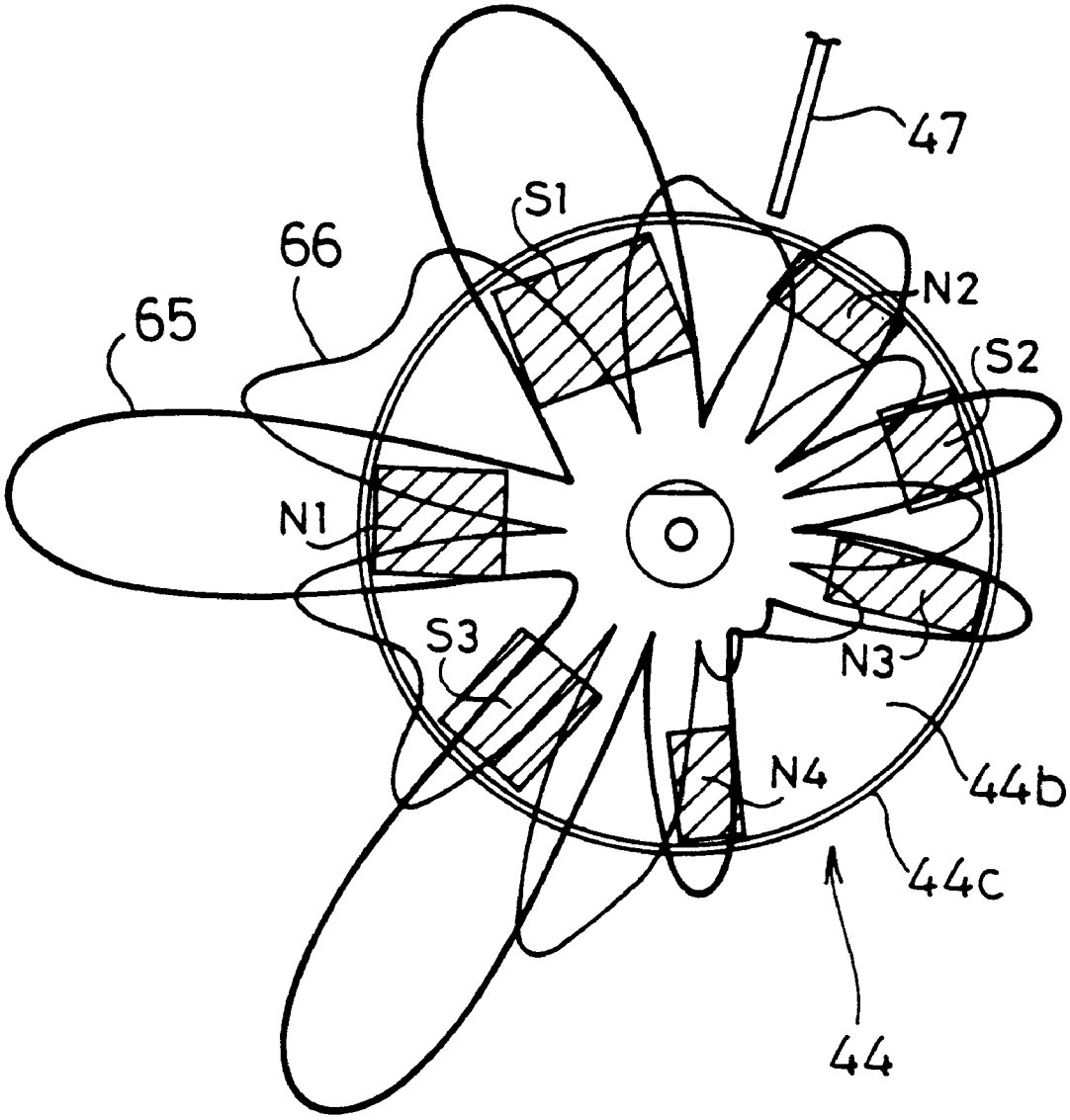
FIG. 14 is an explanatory view showing a positional relationship between a magnetic pattern of the developer roller provided in the development device and a vent formed in front of the doctor and the developer roller.

As a countermeasure, as shown in FIG. 14, the development device 16 is arranged such that the doctor 47 and the vents 64 are positioned at a trough of the magnet pattern 65 in a direction of the diameter of the magnet roller 44*b* which induces the developer to form the magnetic brushes. According to this arrangement, the air flowing at a high speed immediately after being introduced from the vents 64 does not hit the magnetic brushes formed by the developer on the developer roller 44 directly. Instead, the air hit the magnetic brushes after its speed is reduced, thereby preventing the blowing up of the toner, and suppressing the scattering of the toner effectively. Here, the magnetic pattern indicated by 66 in FIG. 14 is a magnetic pattern of the magnet roller 44*b* in the peripheral direction.

Next, the above-described method of (3) will be explained.

At the central portion of the opening section 43 formed on the casing 41, the air-flow rotating in response to the rotation of the developer roller 44 forms laminar flow which tends to draw the floating toner into the casing 41. On the other hand, at the both end portions of the opening section, air turbulence exists which is caused by the air blowing off from the casing 41 and the air-flow rotating in response to the rotation of the developer roller 44.

As a countermeasure, the development device 16 of the present embodiment is designed such that the shape of the edge of the lower portion of the opening section 43 of the casing 41 is varied to have a shape that is suitable to the air flowing in the longitudinal direction of the opening section 43.

Figure 15A:
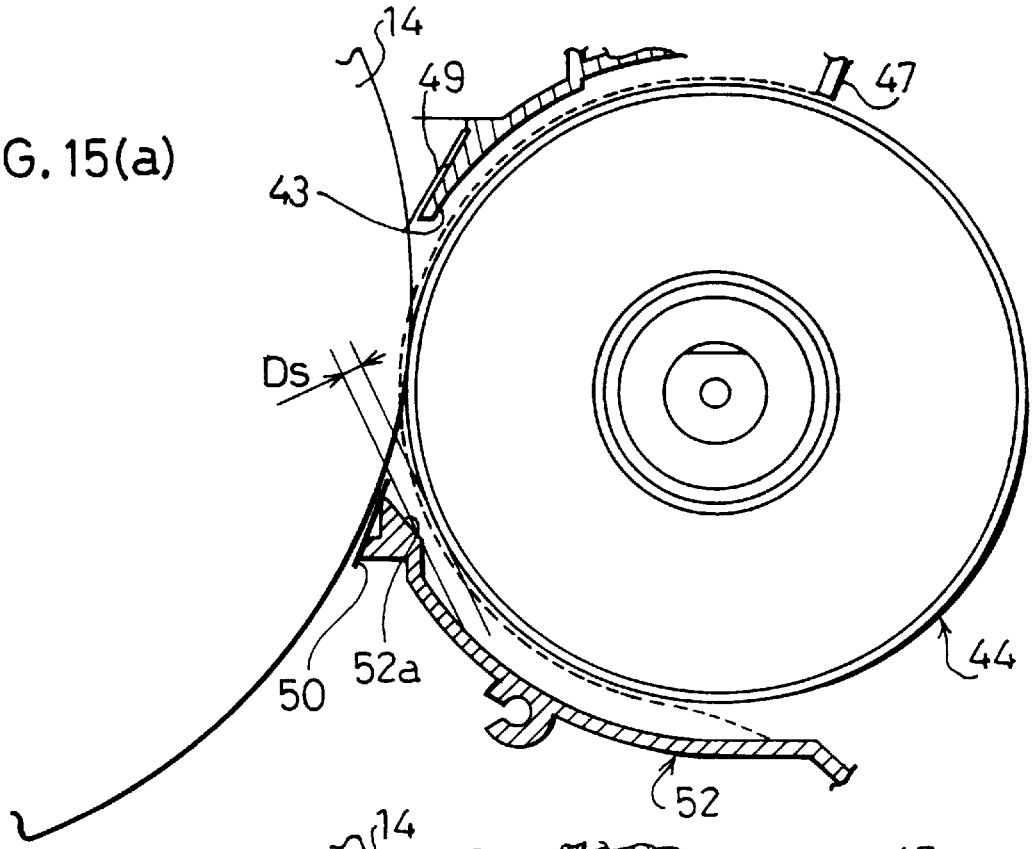
FIG. 15(*a*) is an explanatory view showing a clearance at the central portion of the developer roller formed between the edge of the lower portion of the opening section of the casing and the developer roller in the development device.
Figure 15B:
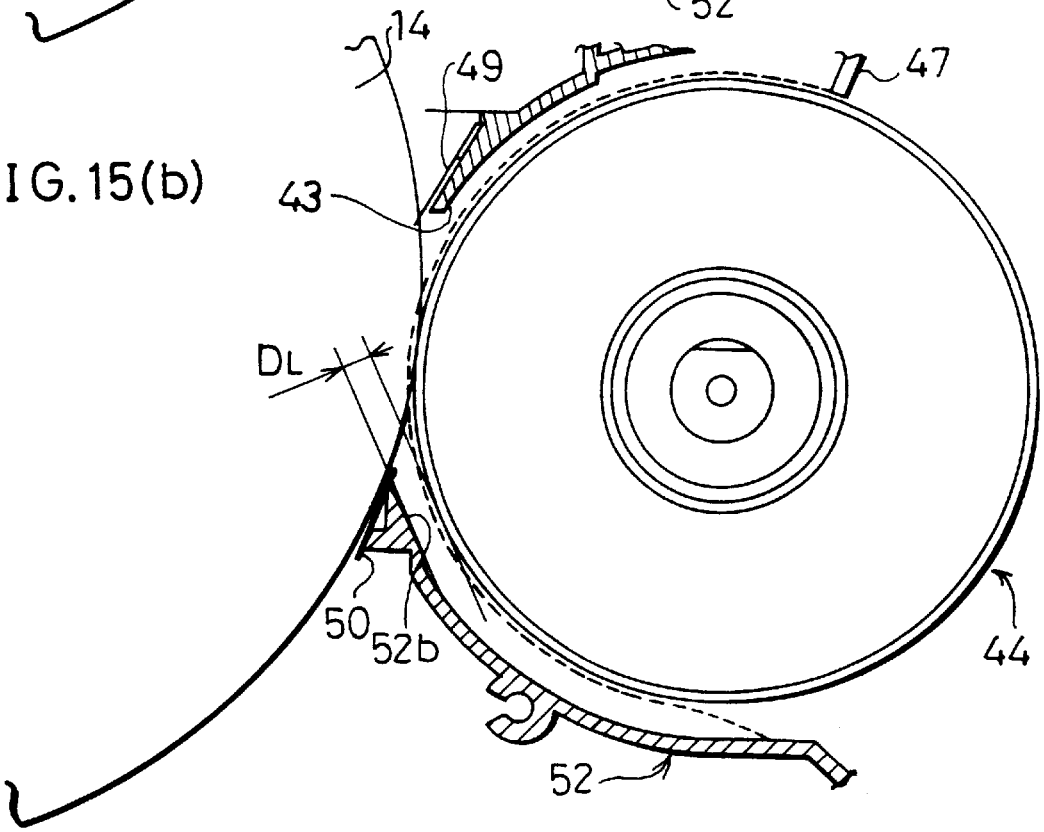
Figure 16B:
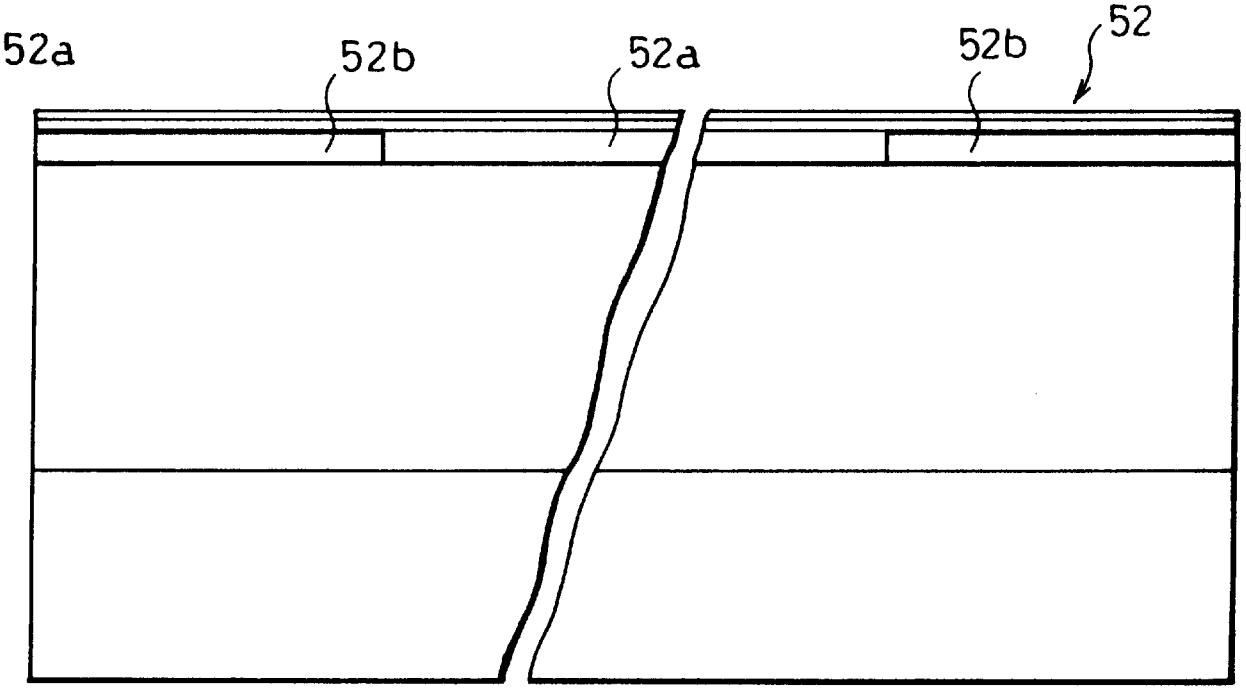
FIG. 16(*a*) is an explanatory view showing an example of the lower casing section as seen from the side which is a component of the casing in the development device.
Figure 16A:
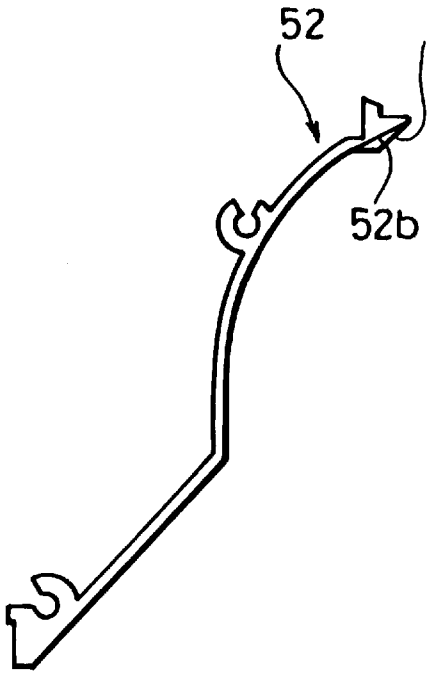

Namely, as shown in FIG. 15(*a*) and FIG. 15(*b*), and FIG. 16(*a*) and FIG. 16(*b*), the shape of a lower casing section 52, which is a component of the casing 41, is formed in such a way that its shape is varied to have a shape that is suitable to the air-flow. Specifically, the lower casing section 52 is arranged so as to cover the lower portion of the developer roller 44. In the lower casing section 52, at the central portion of a portion consisting the lower edge of the opening section 43 is designed so as to have a shape 52*a* such that the gap between the surface of the developer roller 44 and the lower casing section 52 is narrowed. On the other hand, at the side of the end portions, the portion consisting the lower casing section 52 is designed so as to have a shape 52*b* such that the above-mentioned gap is widened.

Here, FIG. 15(*a*) is a cross sectional view of a main section of the side of the lower portion of the developer roller 44 at the central portion, and FIG. 15(*b*) is a cross sectional view of a main section of the side of the lower portion of the developer roller 44 at the side of the end portion. FIG. 16(*a*) is a side view of the lower casing section 52 from the left, and FIG. 16(*b*) is a front view of the lower casing section 52.

According to the above-described arrangement, at the central portion, since the gap between the developer roller 44 and the lower casing section 52 is narrowed, the speed of the air-flow rotating in response to the rotation of the developer roller 44 increases. As a result of this increase in the speed of the air-flow, the air-flow drawn into the casing 41 is further strengthened, and the floating toner is drawn with the air, thereby suppressing the scattering of the toner.

On the other hand, at the side of the end portions, since the gap between the developer roller 44 and the lower casing section 52 is widened, the scattering of the toner at the both end portions also can be suppressed. However, in the case where the gap between the developer roller 44 and the Lower casing section 52 is not widened but narrowed instead, for example, the air-flow stays in front of the narrowest portion. Then the air-flow staying at this portion is drawn by the air-flow rotating in response to the rotation of the photoreceptor, and becomes an air-flow flowing out of the casing 41, therefore the scattering of the toner is increased.

Here, the gap $D_s$ between the surface of the developer roller 44 and the lower casing section 52 at the central portion, and the gap $D_L$ between the surface of the developer roller 44 and the lower casing section 52 at the side of the end portions may be suitably adjusted so as to suppress the scattering of the toner most effectively. For example, by setting the gap to have a value of $D_s$=2.7 mm and $D_L$=4.0 mm, the scattering of the toner can be suppressed effectively. Here, $D_s/D_L$ is typically in a range of 0.4 to 0.9, preferably in a rang e of 0.5 to 0.8, and the most preferably, in a range of 0.6 to 0.75.

Finally, the above-described method of (4) will be explained.

As described above, generally, since the developer does not adhere to the both end portions of the developer roller 44, the gap between the developer roller 44 and the opening section 43 is widened. Hence, the scattering of the toner from the side of the end portions is noticeable. Conventionally, the developer roller and the agitating rollers are designed such that the rotations thereof synchronize with each other by a gear and a timing belt etc.

Figure 18:
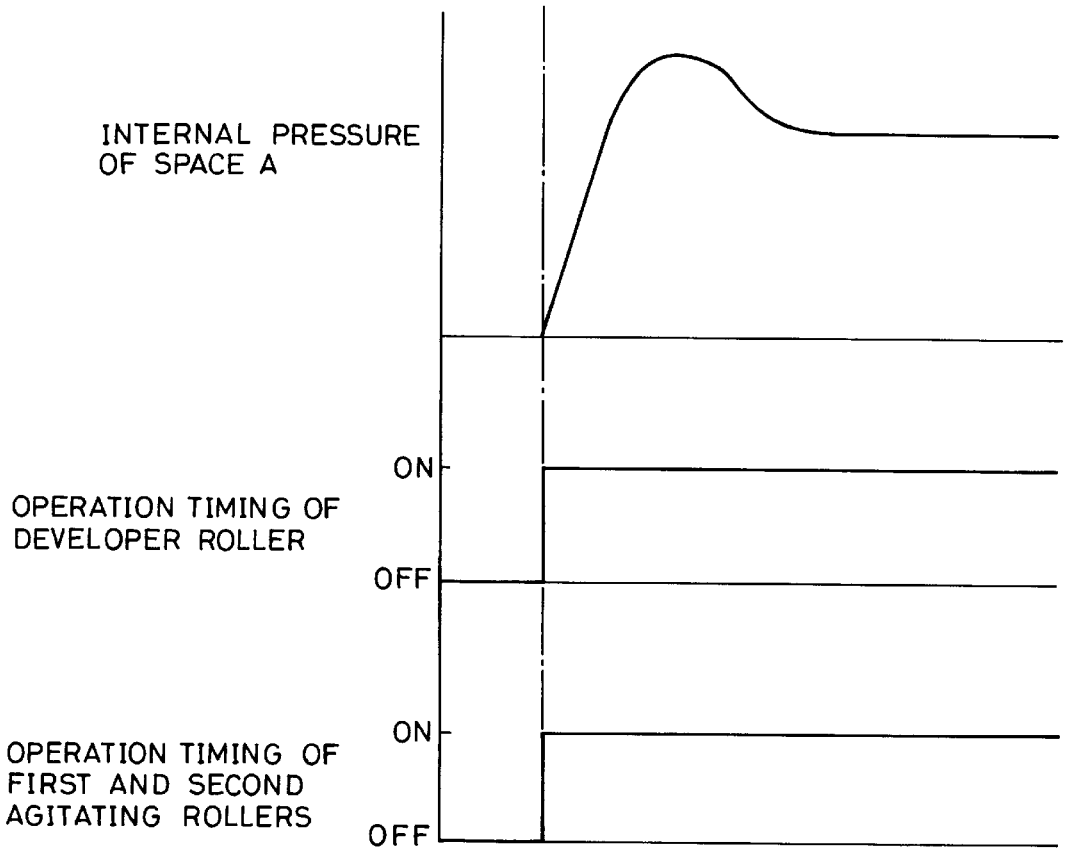
FIG. 18 (PRIOR ART)
FIG. 18 is an explanatory view showing a relationship among a pressure inside the casing in a conventional development device, and an operation timing of the developer roller, and an operation timing of the first and second agitating rollers.
Figure 19:
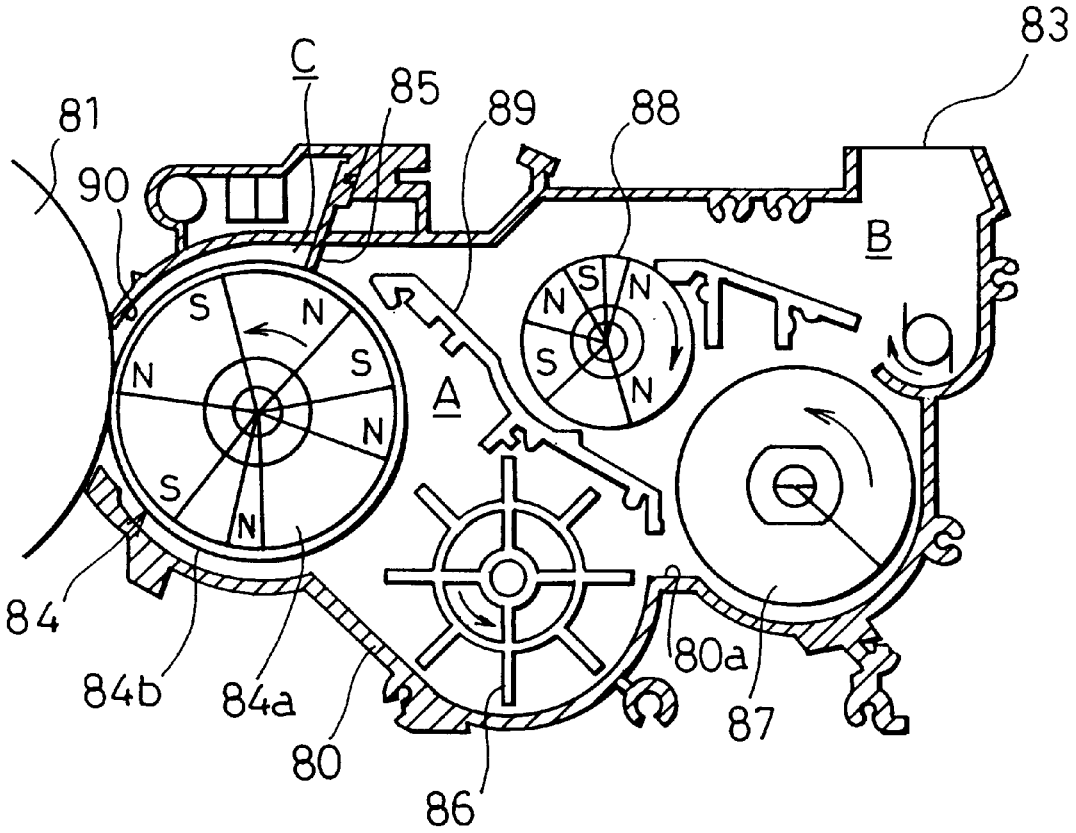
FIG. 19 (PRIOR ART)
FIG. 19 is a cross sectional view showing one embodiment of a development device included in a conventional copying machine.

However, in the case where the rotation start timing of the developer roller 44 and the rotation start timing of the first and second agitating rollers 45 and 46 are synchronized, as shown in FIG. 18, upon starting the rotation, the pressure in the space A increases spontaneously until the rotation and the internal pressure stabilize by the wind in the device generated by the rotations of the developer roller 44 and the first and second agitating rollers 45 and 46, and by the developer flow. In the case where the pressure increases in the described manner, the amount of the scattering of the toner from the side of the end portions cannot be ignored.

Figure 17:
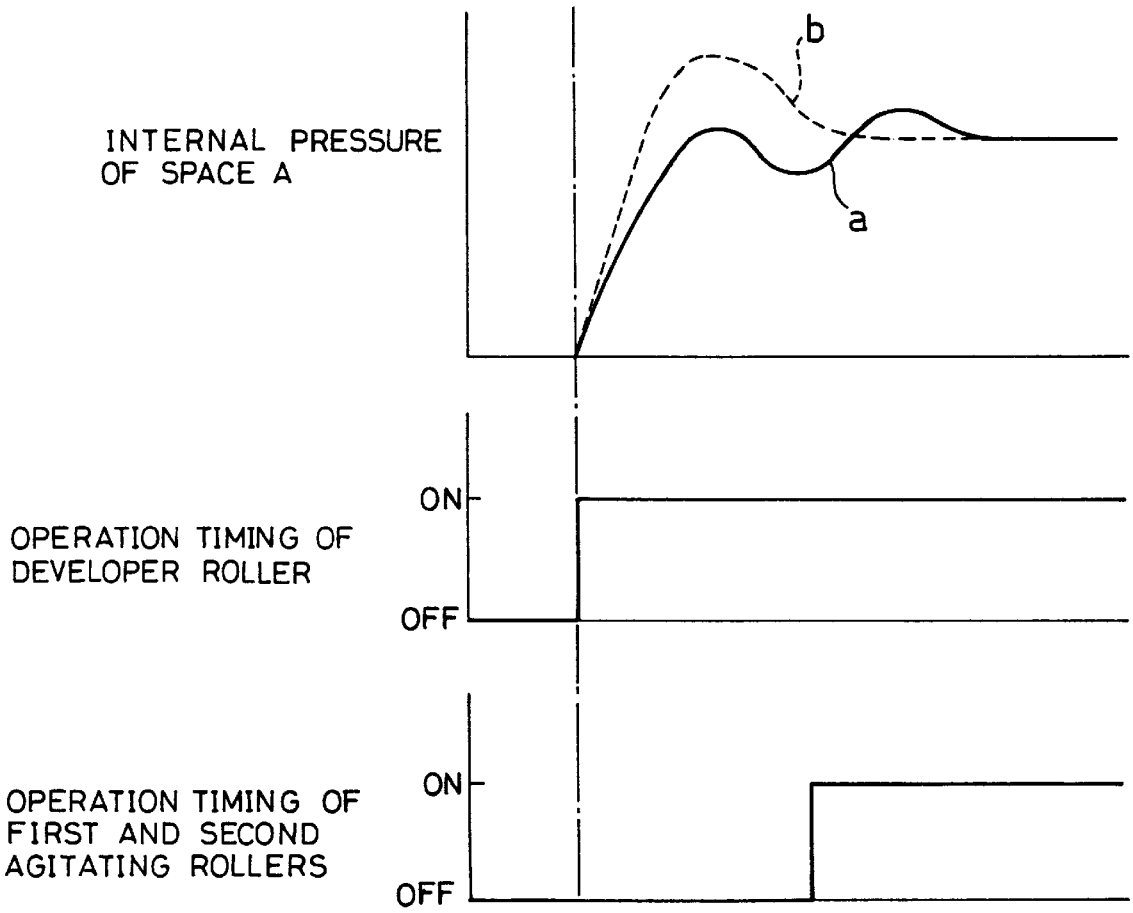
FIG. 17 is an explanatory view showing a relationship among a pressure inside the casing in the development device, and an operation timing of the developer roller, and an operation timing of the first and second agitating rollers.

As a countermeasure, as shown in FIG. 17, in the development device 16, the rotation start timing of the first and second agitating rollers 45 and 46 is delayed with respect to the rotation start timing of the developer roller 44.

According to this arrangement, upon starting the operation of the development device 16, first, only the developer roller 44 is rotated. Then, the rotations of the first and second agitating rollers 45 and 46 are started when a portion of the developer transported by the rotation of the developer roller 44 is regulated by the doctor 47 and flown back to the second agitating roller 46 through the guiding plate 48.

According to this arrangement, as shown in the solid line a in FIG. 17, a spontaneous increase in the internal pressure of the space A is suppressed compared with a conventional case where the start timing is synchronized as shown in the dotted line b in FIG. 17, thereby suppressing the scattering of the toner effectively at a start of the operation.

Here, the delaying of the rotation start timing of the first agitating roller 45 and the second agitating roller 46 with respect to the rotation start timing of the developer roller 44 can be carried out by using a conventionally known technology such as independent driving or a magnetic clutch to delay the rotations thereof.

According to the arrangement of the development device 16 having the methods (1) through (4) as described above, in the copying machine of the present embodiment, the scattering of the toner is almost completely prevented even if the amount of charge of the toner is low and the attraction between the toner and the carrier is weak. Hence, the copying machine of the present embodiment attempts to reduce the running cost by way of extending the life of the carrier by reducing the amount of the toner drawn by the developer roller 44. Furthermore, according to this arrangement, the problem of the scattering of the toner is not generated, thereby meeting the demand in the market.

Here, the development device 16 of the present embodiment has an arrangement where all of the methods (1) through (4) for suppressing the scattering of the toner are adopted in combination. Nevertheless, the scattering of the toner also can be reduced by adopting each method separately, provided that while the method (4) has an effect of suppressing the scattering of the toner at a start of the operation of the development device, the method (4) does not have an effect of suppressing the scattering of the toner caused by the pressure increase in the space A while the device is operated. Therefore, the effect for suppressing the scattering of the toner can be achieved synergistically by adopting the method (4) with any one of the methods (1) through (4) in combination.

As described above, the development device of the image forming apparatus of the present invention includes the developer roller 44 for supplying the developer to the photoreceptor drum 14, the developer roller 44 being rotatably provided inside the casing 41 having the opening section 43 formed so as to face the photoreceptor drum 14, wherein the space A which is the first space, formed on the side of the developer roller 44, having a pressure which increases as the developer roller 44 rotates is parted from the space B which is the second space having a lower pressure than that in the space A, and the development device of the image forming apparatus further includes the vents 60 for connecting the space A and space B.

According to this arrangement, the highly compressed air in the space A is released to the space B having a low pressure through the vents 60, thereby reducing the pressure in the space A. In response to this reduction in the pressure, the scattering of the developer, or the toner in the case the two-component developer is used, from the opening section 43 of the casing 41 parting the space A is reduced. Namely, in the case where the space A having a high pressure and the space B having a low pressure exist in the casing 41, first, the high pressure in the space A inside the casing 41 is reduced by connecting the space A and the space B. By connecting these two spaces, a conventional vent having a filter can be excluded. Therefore, an increase in the number of components as a result of forming the vent having a filter can be avoided. Further, it is not required to connect the space A and the space B to the outside, thereby reducing the scattering of the developer, or especially the toner in the case the two-component developer is used.

It is preferred that the development device of the image forming apparatus having the above-described arrangement further includes the pressure releasing opening 39 having a filter formed on a portion from which the space B is parted in the casing 41.

According to this arrangement, the pressure in the casing 41 is further reduced by the pressure releasing opening 39. Furthermore, the scattering of the toner in the developer from the opening section 43 of the casing 41 is reduced. In this case, the air in the space A having a high pressure is released out of the device through the pressure releasing opening 39 after the pressure in the air is reduced by allowing the air to pass through the connection between the space A and the space B. Therefore the amount of the toner adhering to the filter attached to the pressure releasing opening 39 is reduced, and it is not required to replace the filter as often compared with a conventional case where the highly compressed air directly passes through the filter, thereby making it easier to perform maintenance of the development device 16. Further, since the toner is suppressed from passing through the filter, contamination of the inside of the image forming apparatus by the toner is avoided.

The development device of the image forming apparatus of the present invention having the above-described arrangement may be arranged so as to further include the doctor 47 for regulating the thickness of the developer layer formed on the surface of the developer roller 44, the agitating section, preferably composed of two agitating rollers, the first and second rotatable agitating rollers 45 and 46, which are free to rotate for supplying the developer to the developer roller 44 by agitating the developer, the guiding plate 48 provided such that the upper end portion thereof is positioned in a vicinity of the doctor 47 whereas the lower end portion thereof is inserted in the developer between the developer roller 44 and the first and second agitating rollers 45 and 46, the guiding plate 48 for guiding an excess developer regulated by the doctor 47 to the side of the lower end portion, and the vents 60 formed on the guiding plate 48 for connecting the two spaces A and B with each other formed respectively to the side of the developer roller 44 and the side of the second agitating roller 46 separated by the guiding plate 48.

In addition, it is preferable that the development device having the above-described arrangement includes the pressure releasing opening 39 having a filter formed on a portion of the casing 41 from which the space formed on the side of the first and second agitating rollers 45 and 46 are parted.

According to the above-described arrangement, as described in the explanation of the conventional technology, in the development device having the guiding plate 48, the developer, transported by the rotation of the developer roller 44 and regulated by the doctor 47, flows along the upper surface of the guiding plate 48 back to the side of the first and second agitating rollers 45 and 46 where the developer is agitated again, then the developer is transported again to the developer roller 44. The lower end portion of the guiding plate 48 is inserted in the developer layer, and an amount of the developer to be supplied to the developer 44 is regulated by the clearance formed between the lower end portion of the doctor 47 and the inner wall surface of the casing 41.

In the case where the developer flows in the described manner, inside the casing 41, the two spaces, the space A and the space B, respectively having developer drawn back by the doctor 47 to the side of the upper end portion of the guiding plate 48, and developer to the side of the lower end portion of the guiding plate 48, are parted by the guiding plate 48. The pressure in each of the two spaces A and B becomes high, especially in the space A to the side of the developer roller 44, due to the wind in the device generated by the rotations of the developer roller 44 and the first and second agitating rollers 45 and 46, and by the developer flow. However, the vents 60 for connecting the two spaces A and B are formed on the guiding plate 48. By forming the vents 60, the high pressure in the space A to the side of the developer roller 44 is reduced, thereby reducing the scattering of the toner.

In this case, the pressure is released as the pressure inside the casing 41 is adjusted, which can be carried out only by forming the vents 60 on the guiding plate 48. Therefore, it is not required to prevent the toner from passing through the vents 60 with the air, thereby avoiding an increase in the number of components and the cost, and effectively reducing the scattering of the toner from the opening section 43.

Moreover, by releasing the pressure inside the casing from the pressure releasing opening 39, the scattering of the toner from the opening section 43 can be further reduced. As in the afore-mentioned case, the air in the space A having a high pressure to the side of the developer roller 44 is released out of the development device 16 through the pressure releasing opening 39 after the pressure is reduced by allowing the air to pass through the connection to the space B having a low pressure to the side of the second agitating roller 46. Because the pressure is reduced in this manner, the amount of the toner adhered to the filter attached to the pressure releasing opening 39 is reduced. Therefore, it is not required to replace the filter as often compared with a conventional case where the highly compressed air directly passes through the filter, and also such problem that the toner passes through the filter can be suppressed. In addition, agitation of the developer can be carried out even more sufficiently if the agitating section includes the first and second agitating rollers 45 and 46 as described above.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A development device of an image forming apparatus, comprising:

a casing having an opening section formed so as to face a photoreceptor; and a developer holder for supplying a developer to said photoreceptor, said developer holder being rotatably provided inside said casing, wherein, a first space, formed on the side of said developer holder, having a pressure which increases as said developer holder rotates is parted, inside said casing, from a second space having a lower pressure than that in said first space, said development device further comprising:

a connecting section for connecting said first space and said second space.

2. The development device as set forth in claim 1, wherein:

said casing has a pressure releasing opening having a filter formed on a portion from which said second space is parted.

3. The development device as set forth in claim 1, further including means for guiding and the connection section being provided on the end portion and the central portion of the means for guiding.

4. The development device as set forth in claim 3, wherein the means for guiding is a guiding plate and the means for connecting are vents.

5. A development device of an image forming apparatus, comprising:

a casing having an opening section formed so as to face a photoreceptor;

a developer holder for supplying a developer to said photoreceptor, said developer holder being rotatably provided inside said casing;

a developer layer thickness regulating section for regulating a thickness of a developer layer formed on the surface of said developer holder;

a rotatable agitating section for agitating the developer to be supplied to said developer holder; and a developer-flow regulating plate provided such that the upper end portion thereof is positioned in a vicinity of said developer layer thickness regulating section and the lower end portion thereof is inserted in the developer between said developer holder and said agitating section so as to allow an excess developer regulated by said developer layer thickness regulating section to be guided to the side of the lower end portion along an upper surface of said developer-flow regulating plate, wherein said developer-flow regulating plate has vents for connecting two spaces respectively formed on the side of said developer holder and the side of said agitating section, which are separated by said developer-flow regulating plate.

6. The development device as set forth in claim 5, wherein:

said casing has a pressure releasing opening having a filter formed on a portion from which said space formed on the side of said agitating section is parted.

7. The development device as set forth in claim 6, comprising:

said developer-flow regulating plate has a fall preventing member for preventing the developer from falling through said vents.

8. The development device as set forth in claim 7, wherein:

said fall preventing member is made of a mesh material formed so as to cover said vents.

9. The development device as set forth in claim 8, wherein:

said mesh material has a smaller mesh size than an average diameter of the developer.

10. The development device as set forth in claim 7, wherein:

said fall preventing member is formed by bending a cut-out portion for forming said vents of said developer-flow regulating plate.

11. The development device as set forth in claim 5, wherein:

said developer-flow regulating plate has a fall preventing member for preventing the developer from falling through said vents.

12. The development device as set forth in claim 5, wherein:

said agitating section includes a first agitating roller and a second agitating roller.

13. The development device as set forth in claim 5, wherein:

said vents are formed on portions of said developer-flow regulating plate corresponding to the side of the end portions of said developer holder in a rotation axis direction.

14. A development device of an image forming apparatus, comprising:

a casing having an opening section formed so as to face a photoreceptor;

a developer holder for supplying a developer to said photoreceptor, said developer holder being rotatably provided inside said casing; and a rotatable agitating section for agitating the developer to be supplied to said developer holder, wherein when operating said development device, a rotation start timing of said developer holder and a rotation start timing of said agitating section are different.

15. A development device of an image forming apparatus, comprising:

a casing having an opening section formed so as to face a photoreceptor;

a developer holder for supplying a developer to said photoreceptor, said developer holder being rotatably provided inside said casing;

a developer layer thickness regulating section for regulating a thickness of a developer layer formed on the surface of said developer holder;

a rotatable agitating section for agitating the developer to be supplied to said developer holder; and a developer-flow regulating plate provided such that the upper end portion thereof is positioned in a vicinity of said developer layer thickness regulating section and the lower end portion thereof is inserted in the developer between said developer holder and said agitating section so as to allow an excess developer regulated by said developer layer thickness regulating section to be guided to the side of the lower end portion along an upper surface of said developer-flow regulating plate, wherein when operating said development device, a rotation start timing of said agitating section is delayed from a rotation start timing of said developer holder.

16. A development device of an image forming apparatus, comprising:

a casing having an opening section formed so as to face a photoreceptor;

a developer holder for supplying a developer to said photoreceptor, said developer holder being rotatably provided inside said casing; and a developer layer thickness regulating section for regulating a thickness of a developer layer formed on the surface of said developer holder, said developer layer thickness regulating section fixed to said casing, wherein vents for connecting a vacuum space formed on a front surface portion of said developer layer thickness regulating section and an outside are formed in a vicinity of a fixed position of said developer layer thickness regulating section at both end portions in a longitudinal direction along a rotation axis of said developer holder in said casing, said vents provided so that an air-flow flows into the vacuum space from the outside along a direction parallel to the front surface portion of said developer layer thickness regulating section.

17. The development device as set forth in claim 16, wherein:

said developer is a two-component developer composed of magnetic carrier and toner, said developer holder has a fixed magnet roller and a sleeve rotatably mounted on an outer surface of said fixed magnet roller, and said developer layer thickness regulating section and said vents are formed in a trough in a magnet pattern of said magnet roller.

18. The development device as set forth in claim 16, wherein:

said vents are formed in such positions that an air-flow is generated therethrough from end portions in a rotation axis direction towards a central portion of said developer holder.

19. A development device of an image forming apparatus, comprising:

a casing having an opening section formed so as to face a photoreceptor;

a developer holder for supplying a developer to said photoreceptor, said developer holder being rotatably provided inside said casing, wherein a shape of the edge portion of said opening section on the downstream side in the rotating direction of said developer holder is varied in the longitudinal direction along the rotation axis direction of said developer holder so as to suppress the scattering of the developer from said opening section.

20. The development device as set forth in claim 19, wherein:

the edge portion of said opening section on a downstream side in the rotating direction of said developer holder is arranged such that an interval between said edge portion and said developer holder becomes wider from a central portion towards the end portions in a longitudinal direction of said developer holder.

21. A development device of an image forming apparatus comprising:

a casing having an opening section formed so as to face a photoreceptor; said casing including a developer;

a developer holder for supplying said developer to said photoreceptor, said developer holder being rotatably provided inside said casing; and a developer-flow regulating plate for parting a first space, facing said developer holder, having a pressure which increases as said developer holder rotates from a second space having a lower pressure than that in said first space, said first space and said second space for controlling the supply of said developer to said photoreceptor inside said casing, wherein said developer-flow regulating plate includes vents for connecting said first space and said second space.

* * * * *